US007696847B2

(12) United States Patent
Antaya

(10) Patent No.: US 7,696,847 B2
(45) Date of Patent: Apr. 13, 2010

(54) HIGH-FIELD SYNCHROCYCLOTRON

(75) Inventor: Timothy A. Antaya, Hampton Falls, NH (US)

(73) Assignee: Massachusetts Institute of Technology, Cambridge, MA (US)

( * ) Notice: Subject to any disclaimer, the term of this patent is extended or adjusted under 35 U.S.C. 154(b) by 0 days.

(21) Appl. No.: 12/425,625

(22) Filed: Apr. 17, 2009

(65) Prior Publication Data

US 2009/0206967 A1 Aug. 20, 2009

Related U.S. Application Data

(63) Continuation of application No. 11/624,769, filed on Jan. 19, 2007, now Pat. No. 7,541,905, which is a continuation-in-part of application No. 11/463,403, filed on Aug. 9, 2006, which is a continuation-in-part of application No. 11/337,179, filed on Jan. 19, 2006, now abandoned.

(60) Provisional application No. 60/760,788, filed on Jan. 20, 2006.

(51) Int. Cl.

| | |
|---|---|
| ***H01F 1/00*** | (2006.01) |
| ***H01F 6/00*** | (2006.01) |
| ***H05H 13/00*** | (2006.01) |
| ***H05H 15/00*** | (2006.01) |

(52) U.S. Cl. ..... 335/216; 315/502; 315/503

(58) Field of Classification Search ..... 335/216; 315/502–503

See application file for complete search history.

(56) References Cited

U.S. PATENT DOCUMENTS 1,948,384 A 2/1934 Lawrence
2,872,574 A * 2/1959 McMillan et al. ..... 315/502

(Continued)

FOREIGN PATENT DOCUMENTS

EP 1 605 742 A1 12/2005

(Continued)

OTHER PUBLICATIONS

European Patent Office, "International Search Report and Written Opinion of the International Preliminary Examining Authority," PCT/US2007/001506 (Jul. 5, 2007).

(Continued)

*Primary Examiner*—Elvin G Enad
*Assistant Examiner*—Alexander Talpalatskiy
(74) *Attorney, Agent, or Firm*—Modern Times Legal; Robert J. Sayre

(57) ABSTRACT

The magnetic field in an acceleration chamber defined by a magnet structure is shaped by shaping the poles of a magnetic yoke and/or by providing additional magnetic coils to produce a magnetic field in the median acceleration plane that decreases with increasing radial distance from a central axis. The magnet structure is thereby rendered suitable for the acceleration of charged particles in a synchrocyclotron. The magnetic field in the median acceleration plane is "coil-dominated," meaning that a strong majority of the magnetic field in the median acceleration plane is directly generated by a pair of primary magnetic coils (e.g., superconducting coils) positioned about the acceleration chamber, and the magnet structure is structured to provide both weak focusing and phase stability in the acceleration chamber. The magnet structure can be very compact and can produce particularly high magnetic fields.

27 Claims, 11 Drawing Sheets

U.S. PATENT DOCUMENTS

| | | | | | |
|---|---|---|---|---|---|
| 2,943,265 | A | * | 6/1960 | Kaiser | 315/502 |
| 2,958,327 | A | | 11/1960 | Marancik et al. | |
| 3,175,131 | A | * | 3/1965 | Burleigh et al. | 335/210 |
| 3,868,522 | A | * | 2/1975 | Bigham et al. | 313/62 |
| 3,914,612 | A | * | 10/1975 | Cason et al. | 376/343 |
| 3,921,019 | A | * | 11/1975 | Karasawa | 313/62 |
| 3,925,676 | A | * | 12/1975 | Bigham et al. | 376/112 |
| 4,139,777 | A | * | 2/1979 | Rautenbach | 376/112 |
| 4,353,033 | A | * | 10/1982 | Karasawa | 315/502 |
| 4,507,616 | A | * | 3/1985 | Blosser et al. | 315/502 |
| 4,580,120 | A | * | 4/1986 | Jacquot | 335/301 |
| 4,589,126 | A | | 5/1986 | Augustsson et al. | |
| 4,599,515 | A | * | 7/1986 | Whittemore | 250/390.1 |
| 4,633,125 | A | * | 12/1986 | Blosser et al. | 313/62 |
| 4,641,057 | A | * | 2/1987 | Blosser et al. | 313/62 |
| 4,641,104 | A | * | 2/1987 | Blosser et al. | 315/502 |
| 4,705,955 | A | | 11/1987 | Mileikowsky | |
| 4,726,046 | A | | 2/1988 | Nunan | |
| 4,739,173 | A | | 4/1988 | Blosser et al. | |
| 4,754,147 | A | | 6/1988 | Maughan et al. | |
| 4,771,208 | A | * | 9/1988 | Jongen et al. | 313/62 |
| 4,843,333 | A | * | 6/1989 | Marsing et al. | 315/503 |
| 4,868,843 | A | | 9/1989 | Nunan | |
| 4,868,844 | A | | 9/1989 | Nunan | |
| 4,870,287 | A | | 9/1989 | Cole et al. | |
| 4,905,267 | A | | 2/1990 | Miller et al. | |
| 4,917,344 | A | | 4/1990 | Prechter et al. | |
| 4,943,781 | A | * | 7/1990 | Wilson et al. | 315/502 |
| 4,968,915 | A | * | 11/1990 | Wilson et al. | 313/62 |
| 4,987,309 | A | | 1/1991 | Klasen et al. | |
| 5,017,789 | A | | 5/1991 | Young et al. | |
| 5,017,882 | A | * | 5/1991 | Finlan | 315/502 |
| 5,039,057 | A | | 8/1991 | Prechter et al. | |
| 5,072,123 | A | | 12/1991 | Johnsen | |
| 5,117,829 | A | | 6/1992 | Miller et al. | |
| 5,166,531 | A | | 11/1992 | Huntzinger | |
| 5,240,218 | A | | 8/1993 | Dye | |
| 5,260,581 | A | | 11/1993 | Lesyna et al. | |
| 5,382,914 | A | | 1/1995 | Hamm et al. | |
| 5,440,133 | A | | 8/1995 | Moyers et al. | |
| 5,511,549 | A | | 4/1996 | Legg et al. | |
| 5,521,469 | A | * | 5/1996 | Laisne | 315/502 |
| 5,585,642 | A | | 12/1996 | Britton et al. | |
| 5,668,371 | A | | 9/1997 | Deasy et al. | |
| 5,691,679 | A | | 11/1997 | Ackermann et al. | |
| 5,778,047 | A | | 7/1998 | Mansfield et al. | |
| 5,825,845 | A | | 10/1998 | Blair et al. | |
| 5,866,912 | A | | 2/1999 | Slater et al. | |
| 5,874,811 | A | * | 2/1999 | Finlan et al. | 315/502 |
| 5,895,926 | A | | 4/1999 | Britton et al. | |
| 6,057,655 | A | | 5/2000 | Jongen | |
| 6,107,905 | A | | 8/2000 | Itoh et al. | |
| 6,130,926 | A | * | 10/2000 | Amini | 376/194 |
| 6,279,579 | B1 | | 8/2001 | Riaziat et al. | |
| 6,323,749 | B1 | | 11/2001 | Hsieh | |
| 6,433,336 | B1 | | 8/2002 | Jongen et al. | |
| 6,621,889 | B1 | | 9/2003 | Mostafavi | |
| 6,683,426 | B1 | | 1/2004 | Kleeven | |
| 6,781,492 | B2 | | 8/2004 | Takeshima et al. | |
| 6,864,770 | B2 | | 3/2005 | Nemoto et al. | |
| 2006/0290351 | A1 | | 12/2006 | Matsumoto | |
| 2008/0093567 | A1 | | 4/2008 | Gall | |

FOREIGN PATENT DOCUMENTS

| | | |
|---|---|---|
| JP | 08-264298 | 10/1996 |
| SU | 569 635 | 8/1977 |
| WO | WO-86/07229 | 12/1986 |

OTHER PUBLICATIONS

European Patent Office, "Written Opinion of the International Preliminary Examining Authority," PCT/US2007/001506 (Feb. 18, 2008).

European Patent Office, "International Preliminary Report on Patentability," US2007/001506 (May 6, 2008).

European Patent Office, "International Search Report and Written Opinion of the International Preliminary Examining Authority," PCT/US2007/001628 (Feb. 22, 2008).

European Patent Office, "International Preliminary Report on Patentability," PCT/US2007/001628 (Jul. 8, 2008).

Kim, J. W., et al., "Trim Coil System for the Riken Superconducting Ring Cyclotron", *Proceedings of the 1997 Particle Accelerator Conference*, IEEE, vol. 3, 3422-3424 (1998).

Gordon, M. M., et al., "Extraction Studies for a 250 MeV Superconducting Synchrocyclotron," *Proceedings of the 1987 IEEE Particle Accelerator Conference: Accelerator Engineering and Technology*, 1255-1257 (1987).

Kim, J.W., "An Eight Tesla Superconducting Magnet for Cyclotron Studies," Ph.D. Dissertation, Michigan State University, Department of Physics and Astronomy (1994).

Wikipedia, "Cyclotron," (visited Oct. 6, 2005) <http://en.wikipedia.org/wiki/Cyclotron> (Oct. 6, 2005).

Wikipedia, "Synchrotron," (visited Oct. 6, 2005) <http://en.wikipedia.org/wiki/Synchrotron> (Oct. 6, 2005).

Wu, X., "Conceptual Design and Orbit Dynamics in a 250 MeV Superconducting Synchrocyclotron," Ph.D. Dissertation, Michigan State University, Department of Physics and Astronomy (1990).

Bigham, Clifford B., "Magnetic Trim Rods for Superconducting Cyclotrons", *Nuclear Instruments and Methods* (North Holland Publishing Co.) 141, 223-28 (1975).

Pourrahimi, S., et al., "Powder Metallurgy Processed Nb3Sn(Ta) Wire for High Field NMR Magnets," *IEEE Transactions on Applied Superconductivity*, vol. 5, No. 2, 1603-06 (Jun. 1995).

Goto, A., et al., "Progress on the Sector Magnets for the Riken SRC," *American Institute of Physics, CP600, Cyclotrons and Their Applications 2001, Sixteenth International Conference*, 319-323 (2001).

Chichili, D. R., et al., "Fabrication of Nb3Sn Shell-Type Coils with Pre-Preg Ceramic Insulation", *American Institute of Physics Conference Proceedings, AIP USA*, No. 711 (XP-002436709, ISSN: 0094-243X) (2004).

Patent Abstracts of Japan, "JP 08-264298 A (Cyclotron)" (1996).

* cited by examiner

HIGH-FIELD SYNCHROCYCLOTRON

RELATED APPLICATIONS

This application is a continuation of U.S. patent application Ser. No. 11/624,769, filed on Jan. 19, 2007, which is a continuation-in-part of U.S. patent application Ser. No. 11/463,403, filed Aug. 9, 2006, which is a continuation-in-part of U.S. patent application Ser. No. 11/337,179, filed on Jan. 19, 2006. This application also claims the benefit of U.S. Provisional Application No. 60/760,788, filed on Jan. 20, 2006. Each of these applications is incorporated herein by reference in its entirety.

BACKGROUND

Magnet structures that include a superconducting coil and magnetic poles have been developed for generating magnetic fields in two classes of cyclotrons (isochronous cyclotrons and synchrocyclotrons). Synchrocyclotrons, like all cyclotrons, accelerate charged particles (ions) with a high-frequency alternating voltage in an outward spiraling path from a central axis, where the ions are introduced. Synchrocyclotrons are further characterized in that the frequency of the applied electric field is adjusted as the particles are accelerated to account for relativistic increases in particle mass at increasing velocities. Synchrocyclotrons are also characterized in that they can be very compact, and their size can shrink almost cubically with increases in the magnitude of the magnetic field generated between the poles.

When the magnetic poles are magnetically saturated, a magnetic field of about 2 Tesla can be generated between the poles. The use of superconducting coils in a synchrocyclotron, however, as described in U.S. Pat. No. 4,641,057, which is incorporated herein by reference in its entirety, is reported to increase the magnetic field up to about 5 Tesla. Additional discussion of conceptually using superconducting coils in a cyclotron to generate magnetic fields up to about 5.5 Tesla is provided in X. Wu, "Conceptual Design and Orbit Dynamics in a 250 MeV Superconducting Synchrocyclotron" (1990) (Ph.D. Dissertation, Michigan State University); moreover, discussion of the use of superconducting coils to generate an 8 Tesla field in an isochronous cyclotron (where the magnetic field increases with radius) is provided in J. Kim, "An Eight Tesla Superconducting Magnet for Cyclotron Studies" (1994) (Ph.D. Dissertation, Michigan State University). Both of these theses are available at http://www.nscl.msu.edu/our-lab/library/publications/index.php, and both are incorporated herein by reference in their entirety.

SUMMARY

A compact magnet structure for use in a superconducting synchrocyclotron is described herein that includes a magnetic yoke that defines an acceleration chamber with a median acceleration plane between the poles of the magnet structure. A pair of magnetic coils (i.e., coils that can generate a magnetic field)—herein referred to as "primary" coils—can be contained in passages defined in the yoke, surrounding the acceleration chamber, to directly generate extremely high magnetic fields in the median acceleration plane. When activated, the magnetic coils "magnetize" the magnetic yoke so that the yoke also produces a magnetic field, which can be viewed as being distinct from the field directly generated by the magnetic coils. Both of the magnetic field components (i.e., both the field component generated directly from the coils and the field component generated by the magnetized yoke) pass through the median acceleration plane approximately orthogonal to the median acceleration plane. The magnetic field generated by the fully magnetized yoke at the median acceleration plane, however, is much smaller than the magnetic field generated directly by the coils at that plane. The magnet structure is configured (by shaping the poles, by providing active magnetic coils to produce an opposing magnetic field in the acceleration chamber, or by a combination thereof) to shape the magnetic field along the median acceleration plane so that it decreases with increasing radius from a central axis to the perimeter of the acceleration chamber to enable its use in a synchrocyclotron. In particular embodiments, the primary magnetic coils comprise a material that is superconducting at a temperature of at least 4.5K.

The magnet structure is also designed to provide weak focusing and phase stability in the acceleration of charged particles (ions) in the acceleration chamber. Weak focusing is what maintains the charged particles in space while accelerating in an outward spiral through the magnetic field. Phase stability ensures that the charged particles gain sufficient energy to maintain the desired acceleration in the chamber. Specifically, more voltage than is needed to maintain ion acceleration is provided at all times to high-voltage electrodes in the acceleration chamber; and the magnet structure is configured to provide adequate space in the acceleration chamber for these electrodes and also for an extraction system to extract the accelerated ions from the chamber.

The magnet structure can be used in an ion accelerator that includes a cold-mass structure including at least two superconducting coils symmetrically positioned on opposite sides of an acceleration plane and mounted in a cold bobbin that is suspended by tensioned elements in an evacuated cryostat. Surrounding the cold-mass structure is a magnetic yoke formed, e.g., of low-carbon steel. Together, the cold-mass structure and the yoke generate a combined field, e.g., of about 7 Tesla or more (and in particular embodiments, 9 Tesla or more) in the acceleration plane of an evacuated beam chamber between the poles for accelerating ions. The superconducting coils generate a substantial majority of the magnetic field in the chamber, e.g., about 5 Tesla or more (and in particular embodiments, about 7 Tesla or more), when the coils are placed in a superconducting state and when a voltage is applied thereto to initiate and maintain a continuous electric current flow through the coils. The yoke is magnetized by the field generated by the superconducting coils and can contribute another 2 Tesla to the magnetic field generated in the chamber for ion acceleration.

With the high magnetic fields, the magnet structure can be made exceptionally small. In an embodiment with the combined magnetic field of 7 Tesla in the acceleration plane, the outer radius of the magnetic yoke is 45 inches (~114 cm) or less. In magnet structures designed for use with higher magnetic fields, the outer radius of the magnetic yoke will be even smaller. Particular additional embodiments of the magnet structure are designed for use where the magnetic field in the median acceleration plane is, e.g., 8.9 Tesla or more, 9.5 Tesla or more, 10 Tesla or more, at other fields between 7 and 13 Tesla, and at fields above 13 Tesla.

The radius of the coils can be 20 inches (~51 cm) or less—again being made even smaller for use with increased magnetic fields, and the superconducting material in the coils can be $Nb_3Sn$, which can be used to generate a starting magnetic field of 9.9 Tesla or greater in the pole gap for acceleration, or NbTi, which can be used to generate a starting magnetic field of 8.4 Tesla or greater in the pole gap for acceleration. In a particular embodiment, each coil is formed of an A15 $Nb_3Sn$ type-II superconductor. The coils can be formed by winding a reacted $Nb_3Sn$ composite conductor in a circular ring shape or in the form of a set of concentric rings. The composite conductor can be a cable of reacted $Nb_3Sn$ wires soldered in a copper channel or the cable, alone. The cable is assembled from a predetermined number of strands of precursor tin and niobium constituents with copper and barrier materials. The wound strands are then heated to react the matrix constituents to form $Nb_3Sn$, wherein the niobium content in the structure increases closer to the perimeter of the cross-section of the strand.

Additionally, an electrically conductive wire coupled with a voltage source can be wrapped around each coil. The wire can then be used to "quench" the superconducting coil (i.e., to render the entire coil "normal" rather than superconducting) by applying a sufficient voltage to the wire when the coil first starts to lose its superconductivity at its inner edge during operation, thereby preserving the coil by removing the possibility of its operation with localized hot spots of high resistivity. Alternatively, stainless steel or other conductive metallic (such as copper or brass) strips can be attached to the coil perimeter or embedded in the coils, such that when a current passes through the strips, the coil is heated so as to quench the superconducting state and thereby protect the coil.

During operation, the coils can be maintained in a "dry" condition (i.e., not immersed in liquid refrigerant); rather, the coils can be cooled to a temperature below the superconductor's critical temperature by cryocoolers. Further, the cold-mass structure can be coupled with a plurality of radial tension members that serve to keep the cold-mass structure centered about the central axis in the presence and influence of the especially high magnetic fields generated during operation.

The magnetic yoke includes a pair of approximately symmetrical poles. The inner surfaces of the poles feature a unique profile, jointly defining a pole gap there between that is tapered as a function of distance from a central axis. The profile serves (1) to establish a correct weak focusing circular particle accelerator requirement for ion acceleration (via an expanding gap at increasing distances from the central axis over an inner stage) and (2) to reduce pole diameter by increasing energy gain versus radius (via a rapidly decreasing pole gap at increasing radial distances over an outer stage).

Additionally, the ion accelerator can have a suitable compact beam chamber, dee and resonator structure in which the ions are formed, captured into accelerated orbits, accelerated to final energy and then extracted for use in a number of ion-beam applications. The beam chamber, resonator and dee structure reside in an open space between the poles of the superconducting-magnet structure, and the magnet structure is accordingly configured to accommodate these components. The beam chamber includes provisions for ion-beam formation. The ions may be formed in an internal ion source, or may be provided by an external ion source with an ion-injection structure. The beam chamber is evacuated and serves additionally as the ground plane of the radiofrequency-accelerating structure. The RF-accelerating structure includes a dee or multiple dees, other surfaces and structures defining acceleration gaps, and means of conveying the radiofrequency waves from an external generator into the beam chamber for excitation of the dee or multiple dees.

Further still, an integral magnetic shield can be provided to surround the yoke and to contain external magnetic fields generated there from. The integral magnetic shield can be formed of low-carbon steel (similar to the yoke) and is positioned outside the contour of a 1,000-gauss magnetic flux density that can be generated by the magnet structure during its operation. The shield can have a tortuous shape such that magnetic flux lines extending out of the yoke will intersect the integrated magnetic shield at a plurality of locations and at a plurality of angles to enable improved containment of magnetic fields having various orientations. The heads of the cryocoolers and other active elements that are sensitive to high magnetic fields are positioned outside the integral magnetic shield.

The apparatus and methods of this disclosure enable the generation of high magnetic fields from a very compact structure, thereby enabling the generation of a point-like beam (i.e., having a small spatial cross-section) of high-energy (and short-wavelength) particles. Additionally, the integral magnetic shield of this disclosure enables excellent containment of the magnetic fields generated therefrom. The compact structures of this disclosure can be used in particle accelerators in a wide variety of applications, wherein the accelerator can be used in a transportable form, e.g., on a cart or in a vehicle and relocated to provide a temporary source of energetic ions for diagnostic use or threat detection, such as in a security system at a port or at other types of transportation centers. The accelerator can accordingly be used at a location of need, rather than solely at a dedicated accelerator facility. Further still, the accelerator can be mounted, e.g., on a gantry for displacement of the accelerator about a fixed target (e.g., a medical patient) in a single-room system to irradiate the target with accelerated ions from the accelerator from a variety of different source positions.

BRIEF DESCRIPTION OF THE DRAWINGS

In the accompanying drawings, described below, like reference characters refer to the same or similar parts throughout the different views. The drawings are not necessarily to scale, emphasis instead being placed upon illustrating particular principles of the methods and apparatus characterized in the Detailed Description.

DETAILED DESCRIPTION

Figure 1:
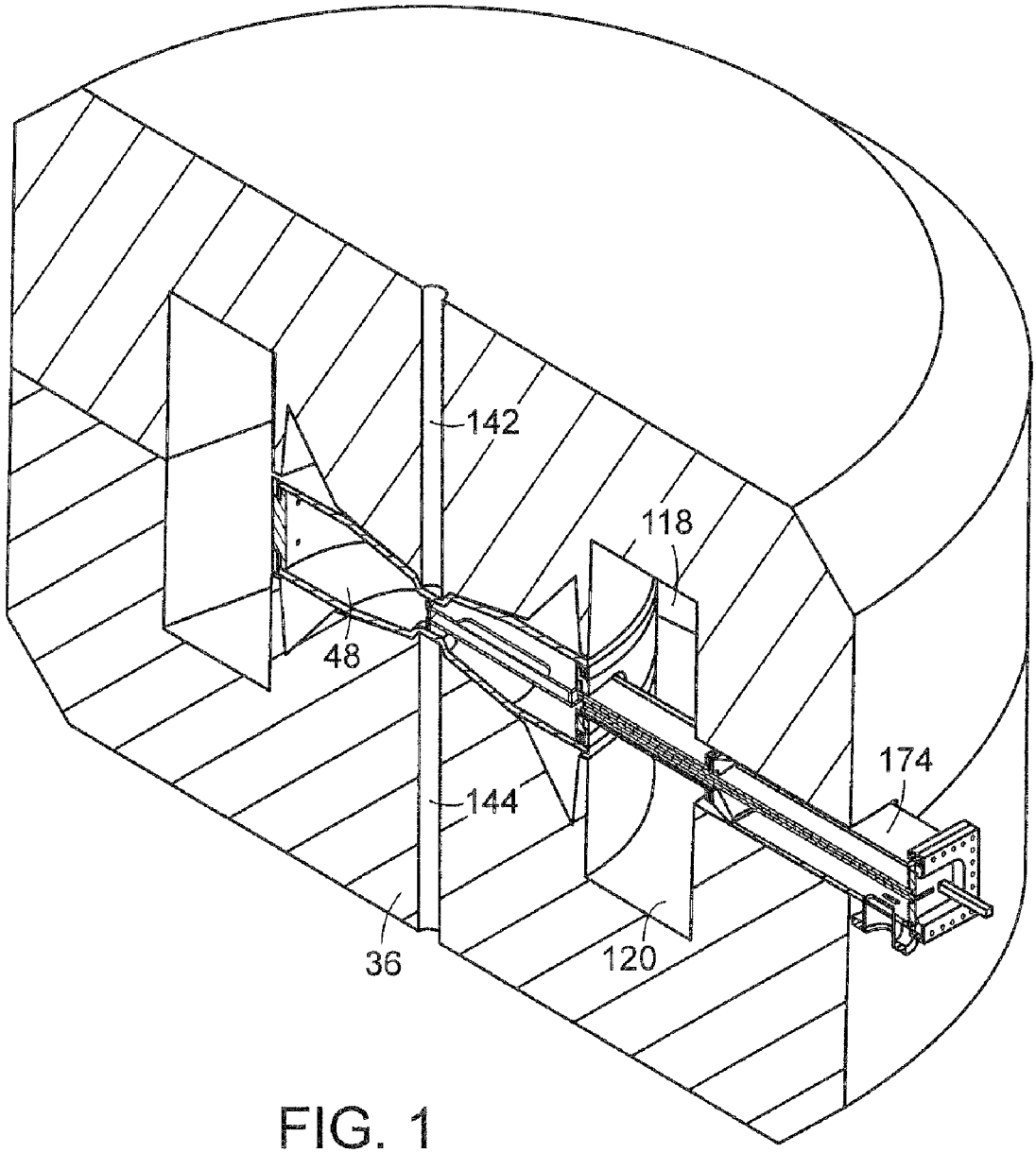
FIG. 1 is a perspective sectioned diagram showing the basic structure of a high-field synchrocyclotron, omitting the coil/cryostat assembly.

Many of the inventions described herein have broad applicability beyond their implementation in synchrocyclotrons (e.g., in isochronous cyclotrons and in other applications employing superconductors and/or for generating high magnetic fields) and can be readily employed in other contexts. For ease of reference, however, this description begins with an explanation of underlying principles and features in the context of a synchrocyclotron.

Synchrocyclotrons, in general, may be characterized by the charge, Q, of the ion species; by the mass, M, of the accelerated ion; by the acceleration voltage, $V_0$; by the final energy, E; by the final radius, R, from a central axis; and by the central field, $B_0$. The parameters, $B_0$ and R, are related to the final energy such that only one need be specified. In particular, one may characterize a synchrocyclotron by the set of parameters, Q, M, E, $V_0$ and $B_0$. The high-field superconducting synchrocyclotron of this discourse includes a number of important features and elements, which function, following the principles of synchronous acceleration, to create, accelerate and extract ions of a particular Q, M, $V_0$, E and $B_0$. In addition, when the central field alone is raised and all other key parameters held constant, it is seen that the final radius of the accelerator decreases in proportion; and the synchrocyclotron becomes more compact. This increasing overall compactness with increasing central field, $B_0$, can be characterized approximately by the final radius to the third power, $R^3$, and is shown in the table below, in which a large increase in field results in a large decrease in the approximate volume of the synchrocyclotron.

| $B_0$ (Tesla) | R (m) | $(R/R_1)^3$ |
|---|---|---|
| 1 | 2.28 | 1 |
| 3 | 0.76 | 1/27 |
| 5 | 0.46 | 1/125 |
| 7 | 0.33 | 1/343 |
| 9 | 0.25 | 1/729 |

The final column in the above chart represents the volume scaling, wherein $R_1$ is the pole radius of 2.28 m, where $B_0$ is 1 Tesla; and R is the corresponding radius for the central field, $B_0$, in each row. In this case, $M=\rho_{iron} V$, and $E=K (R B_0)^2=250$ MeV, wherein V is volume.

One factor that changes significantly with this increase in central field, $B_0$, is the cost of the synchrocyclotron, which will decrease. Another factor that changes significantly is the portability of the synchrocyclotron; i.e., the synchrocyclotron should be easier to relocate; for example, the synchrocyclotron can then be placed upon a gantry and moved around a patient for cancer radiotherapy, or the synchrocyclotron can be placed upon a cart or a truck for use in mobile applications, such as gateway-security-screening applications utilizing energetic beams of point-like particles. Another factor that changes with increasing field is size; i.e., all of the features and essential elements of the synchrocyclotron and the properties of the ion acceleration also decrease substantially in size with increasing field. Described herein is a manner in which the synchrocyclotron may be significantly decreased in overall size (for a fixed ion species and final energy) by raising the magnetic field using superconducting magnetic structures that generate the fields.

With increasing field, $B_0$, the synchrocyclotron possesses a structure for generating the required magnetic energy for a given energy, E; charge, Q; mass, M; and accelerating voltage, $V_0$. This magnetic structure provides stability and protection for the superconducting elements of the structure, mitigates the large electromagnetic forces that also occur with increasing central field, $B_0$, and provides cooling to the superconducting cold mass, while generating the required total magnetic field and field shape characteristic of synchronous particle acceleration.

The yoke 36, dee 48 and resonator structure 174 of a 9.2-Tesla, 250-MeV-proton superconducting synchrocyclotron having $Nb_3Sn$-conductor-based superconducting coils (not shown) operating at peak fields of 11.2 Tesla are illustrated in FIG. 1. This synchrocyclotron solution was predicated by a new scaling method from the solution obtained at 5.5 Tesla in X. Wu, "Conceptual Design and Orbit Dynamics in a 250 MeV Superconducting Synchrocyclotron" (1990) (Ph.D. Dissertation, Michigan State University); it is believed that the Wu thesis suggested the highest central field ($B_0$) level in a design for a synchrocyclotron up to that point in time—provided in a detailed analysis effort or demonstrated experimentally in operation.

These high-field scaling rules do not require that the new ion species be the same as in the particular examples provided herein (i.e., the scaling laws are more general than just 250 MeV and protons); the charge, Q, and the mass, M, can, in fact, be different; and a scaling solution can be determined for a new species with a different Q and M. For example, in another embodiment, the ions are carbon atoms stripped of electrons for a +6 charge (i.e., $^{12}C^{6+}$); in this embodiment, less extreme field shaping would be needed (e.g., the profiles of the pole surfaces would be flatter) compared with a lower-mass, lower-charge particle. Also, the new scaled energy, E, may be different from the previous final energy. Further still, $B_0$ can also be changed. With each of these changes, the synchrocyclotron mode of acceleration can be preserved.

The ferromagnetic iron yoke 36 surrounds the accelerating region in which the beam chamber, dee 48 and resonator structure 174 reside; the yoke 36 also surrounds the space for the magnet cryostat, indicated by the upper-magnet cryostat cavity 118 and by the lower-magnet cryostat cavity 120. The acceleration-system beam chamber, dee 48 and resonator structure 174 are sized for an E=250 MeV proton beam (Q=1, M=1) at an acceleration voltage, $V_0$, of less than 20 kV. The ferromagnetic iron core and return yoke 36 is designed as a split structure to facilitate assembly and maintenance; and it has an outer radius less than 35 inches (~89 cm), a total height less than 40 inches (~100 cm), and a total mass less than 25 tons (~23,000 kg). The yoke 36 is maintained at room temperature. This particular solution can be used in any of the previous applications that have been identified as enabled by a compact, high-field superconducting synchrocyclotron, such as on a gantry, a platform, or a truck or in a fixed position at an application site.

For clarity, numerous other features of the ferromagnetic iron yoke structure 36 for high-field synchrocyclotron operation are not shown in FIG. 1. These features are now shown in FIG. 2. The structure of the synchrocyclotron approaches 360-degree rotational symmetry about its main axis 16, allowing for discrete ports and other discrete features at particular locations, as illustrated elsewhere herein. The synchrocyclotron also has a median acceleration plane 18, which is the mirror-symmetry plane for the ferromagnetic yoke 36, and the mid-plane of the split coil pair 12 and 14; the median acceleration plane also is the vertical center of the beam chamber (defined between the poles 38 and 40), dee 48 and resonator structure 174 and of the particle trajectories during acceleration. The ferromagnetic yoke structure 36 of the high-field synchrocyclotron is composed of multiple elements. The magnet poles 38 and 40 define an upper central passage 142 and a lower central passage 144, aligned about the central axis 16 of the synchrocyclotron and each with a diameter of about 3 inches (~7.6 cm), which provide access for insertion and removal of the ion source, which is positioned on the main axis 16 at the median plane 18 in the central region of the acceleration chamber 46.

Figure 2:
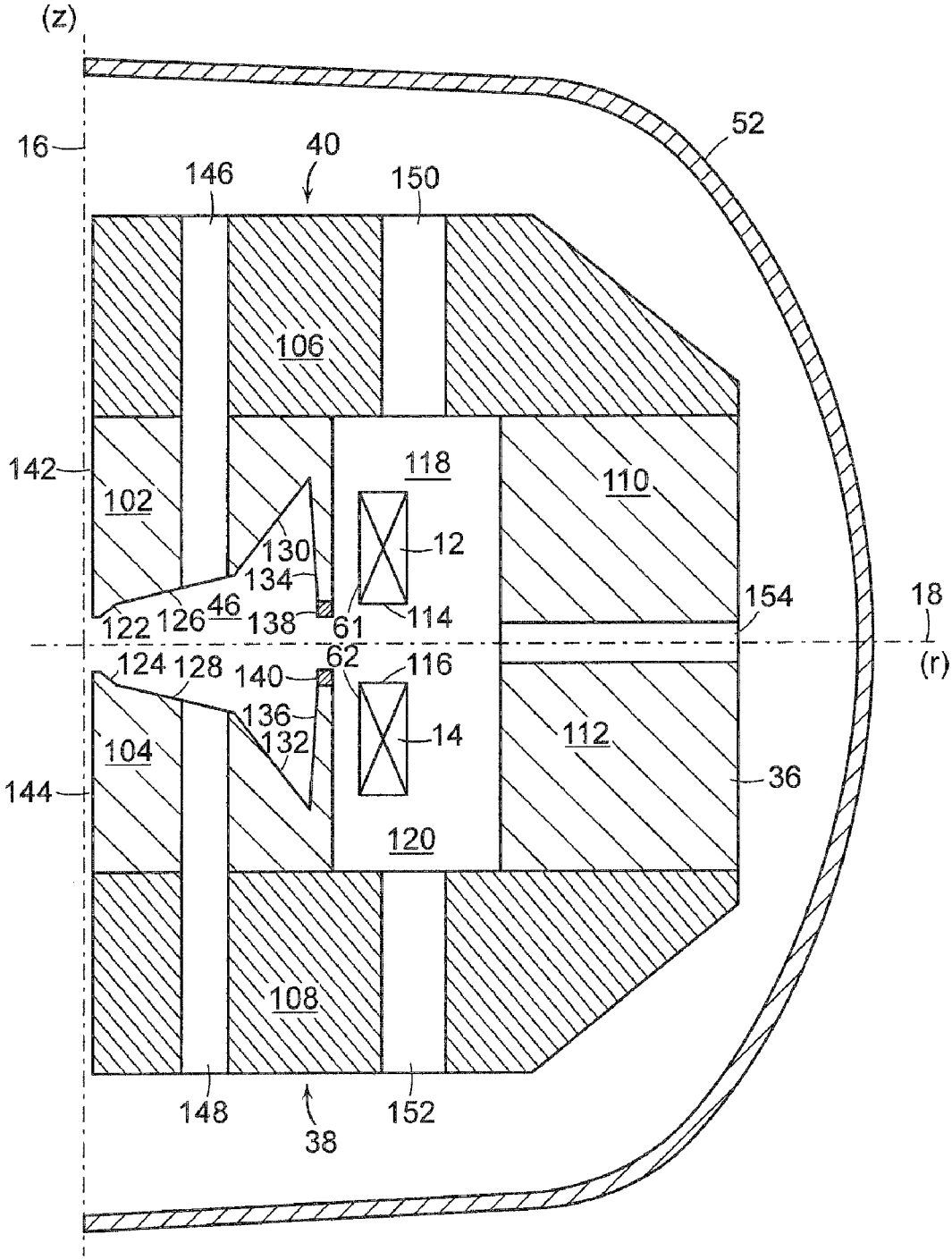
FIG. 2 is a sectional illustration of the ferromagnetic material and the magnet coils for the high-field synchrocyclotron.

A detailed magnetic field structure is utilized to provide stable acceleration of the ions. The detailed magnetic field configuration is provided by shaping of the ferromagnetic iron yoke 36, through shaping of the upper and lower pole tip contours 122 and 124 and upper and lower pole contours 126 and 128 for initial acceleration and by shaping upper and lower pole contours 130 and 132 for high-field acceleration. In the embodiment of FIG. 2, the maximum pole gap between the upper and lower pole contours 130 and 132 (adjacent the upper and lower pole wings 134 and 136) is more than twice the size of the maximum pole gap between the upper and lower pole contours 126 and 128 and more than five times the size of the minimum pole gap at the upper and lower pole tip contours 122 and 124. As shown, the slopes of the upper and lower pole tip contours 122 and 124 are steeper than the slopes of the adjacent upper and lower pole contours 126 and 128 for initial acceleration. Beyond the comparatively slight slope of the upper and lower pole contours 126 and 128, the slopes of the upper and lower pole contours 130 and 132 for high-field acceleration again substantially increase (for contour 130) and decrease (for contour 132) to increase the rate at which the pole gap expands as a function of increasing radial distance from the central (main) axis 16.

Moving radially outward, the slopes of the surfaces of the upper and lower pole wings 134 and 136 are even steeper than (and inverse to) the slopes of the upper and lower pole contours 130 and 132, such that the size of the pole gap quickly drops (by a factor of more than five) with increasing radius between the pole wings 134 and 136. Accordingly, the structure of the pole wings 134 and 136 provides substantial shielding from the magnetic fields generated by the coils 12 and 14 toward the outer perimeter of the acceleration chamber by trapping inner field lines proximate to the coils 12 and 14 to thereby sharpen the drop off of the field beyond those trapped field lines. The furthest gap, which is between the junction of the wing 134 with surface 130 and the junction of the wing 136 and surface 132 is about 37 cm. This gap then abruptly narrows (at an angle between 80 and 90°—e.g., at an angle of about 85°—to the median acceleration plane 18) to about 6 cm between the tips 138 and 140. Accordingly, the gap between the pole wings 134 and 136 can be less than one-third (or even less than one-fifth) the size of the furthest gap between the poles. The gap between the coils 12 and 14, in this embodiment, is about 10 cm.

In embodiments where the magnetic field from the coils is increased, the coils 12 and 14 include more amp-turns and are split further apart from each other and are also positioned closer to the respective wings 134 and 136. Moreover, in the magnet structure designed for the increased field, the pole gap is increased between contours 126 and 128 and between contours 130 and 132), while the pole gap is narrowed between the perimeter tips 138 and 140 (e.g., to about 3.8 cm in a magnet structure designed for a 14 Tesla field) and between the center tips 122 and 124. Further still, in these embodiments, the thickness of the wings 134 and 136 (measured parallel to the acceleration plane 18) is increased. Moreover, the applied voltage is lower, and the orbits of the ions are more compact and greater in number; the axial and radial beam spread is smaller.

These contour changes, shown in FIG. 2, are representative only—as for each high-field-synchrocyclotron scaling solution, there may be a different number of pole taper changes to accommodate phase-stable acceleration and weak focusing; the surfaces may also have smoothly varying contours. Ions have an average trajectory in the form of a spiral expanding along a radius, r. The ions also undergo small orthogonal oscillations around this average trajectory. These small oscillations about the average radius are known as betatron oscillations, and they define particular characteristics of accelerating ions.

The upper and lower pole wings 134 and 136 sharpen the magnetic field edge for extraction by moving the characteristic orbit resonance, which sets the final obtainable energy closer to the pole edge. The upper and lower pole wings 134 and 136 additionally serve to shield the internal acceleration field from the strong split coil pair 12 and 14. Conventional regenerative synchrocyclotron extraction or self-extraction is accommodated by allowing additional localized pieces of ferromagnetic upper and lower iron tips 138 and 140 to be placed circumferentially around the face of the upper and lower pole wings 134 and 136 to establish a sufficient non-axi-symmetric edge field.

In particular embodiments, the iron tips 138 and 140 are separated from the respective upper and lower pole wings 134 and 136 via a gap there between; the iron tips 138 and 140 can thereby be incorporated inside the beam chamber, whereby the chamber walls pass through that gap. The iron tips 138 and 140 will still be in the magnetic circuit, though they will be separately fixed.

Figure 3:
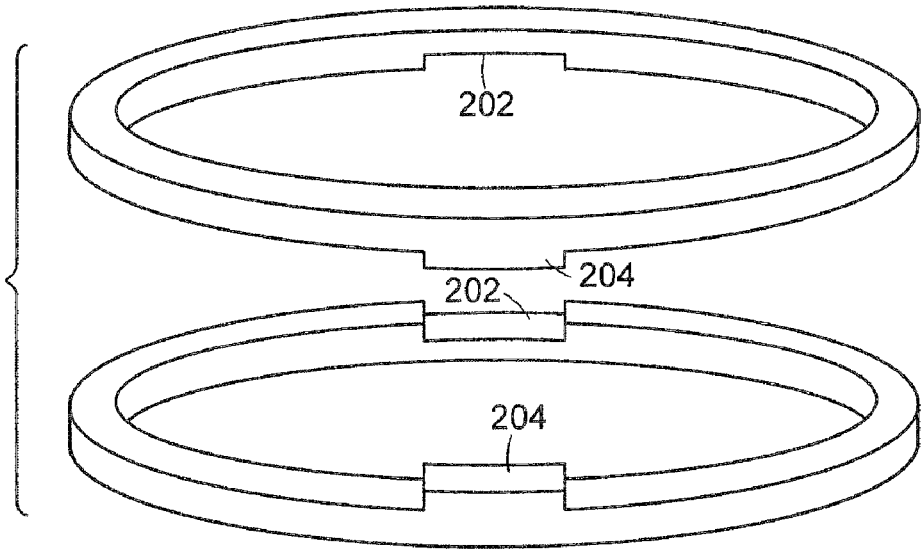
FIG. 3 is an illustration of a pair of iron tip rings that extend from respective pole wings and that share a common central axis of orientation, with the gap there between extended in the drawing to better facilitate illustration.

In other embodiments, as shown in FIG. 3, the iron tips 138 and 140 or the pole wings 134 and 136 can be non-symmetrical about the central axis 16, with the inclusion, e.g., of slots 202 and extensions 204 to respectively decrease and increase the magnetic field at those locales. In still other embodiments, the iron tips 138 and 140 are not continuous around the circumference of the poles 38 and 40, but rather are in the form of distinct segments separated by gaps, wherein lower local fields are generated at the gaps. In yet another embodiment, differing local fields are generated by varying the composition of the iron tips 138 and 140 or by incorporating selected materials having distinct magnetic properties at different positions around the circumference of the tips 138 and 140. The composition elsewhere in the magnetic yoke can also be varied (e.g., by providing different materials having distinct magnetic properties) to shape the magnetic field (i.e., to raise or lower the field), as desired (e.g., to provide weak focusing and phase stability for the accelerated ions), in particular regions of the median acceleration plane.

Multiple radial passages 154 defined in the ferromagnetic iron yoke 36 provide access across the median plane 18 of the synchrocyclotron. The median-plane passages 154 are used for beam extraction and for penetration of the resonator inner conductor 186 and resonator outer conductor 188 (see FIG. 5). An alternative method for access to the ion-accelerating structure in the pole gap volume is through upper axial RF passage 146 and through lower axial RF passage 148.

The cold-mass structure and cryostat (not shown) include a number of penetrations for leads, cryogens, structural supports and vacuum pumping, and these penetrations are accommodated within the ferromagnet core and yoke 36 through the upper-pole cryostat passage 150 and through the lower-pole cryostat passage 152. The cryostat is constructed of a non-magnetic material (e.g., an INCONEL nickel-based alloy, available from Special Metals Corporation of Huntington, W. Va., USA)

The ferromagnetic iron yoke 36 comprises a magnetic circuit that carries the magnetic flux generated by the superconducting coils 12 and 14 to the acceleration chamber 46. The magnetic circuit through the yoke 36 also provides field shaping for synchrocyclotron weak focusing at the upper pole tip 102 and at the lower pole tip 104. The magnetic circuit also enhances the magnet field levels in the acceleration chamber by containing most of the magnetic flux in the outer part of the magnetic circuit, which includes the following ferromagnetic yoke elements: upper pole root 106 with corresponding lower pole root 108, the upper return yoke 110 with corresponding lower return yoke 112. The ferromagnetic yoke 36 is made of a ferromagnetic substance, which, even though saturated, provides the field shaping in the acceleration chamber 46 for ion acceleration.

The upper and lower magnet cryostat cavities 118 and 120 contain the upper and lower superconducting coils 12 and 14 as well as the superconducting cold-mass structure and cryostat surrounding the coils, not shown.

The location and shape of the coils 12 and 14 are also important to the scaling of a new synchrocyclotron orbit solution for a given E, Q, M and $V_0$, when $B_0$ is significantly increased. The bottom surface 114 of the upper coil 12 faces the opposite top surface 116 of the bottom coil 14. The upper-pole wing 134 faces the inner surface 61 of the upper coil 12; and, similarly, the lower-pole wing 136 faces the inner surface 62 of the lower coil 14.

Without additional shielding, the concentrated high-magnetic-field levels (inside the high-field superconducting synchrocyclotron or near the external surface of the ferromagnetic yoke 36) would pose a potential hazard to personnel and equipment in nearby proximity, through magnetic attraction or magnetization effects. An integral external shield 60 of ferromagnetic material, sized for the overall external reduction in field level required, may be used to minimize the magnetic fields away from the synchrocyclotron. The shield 60 may be in the form of layers or may have a convoluted surface for additional local shielding, and may have passages for synchrocyclotron services and for the final external-beam-transport system away from the cyclotron.

Synchrocyclotrons are a member of the circular class of particle accelerators. The beam theory of the circular particle accelerators is well-developed, based upon the following two key concepts: equilibrium orbits and betatron oscillations around equilibrium orbits. The principle of equilibrium orbits (EOs) can be described as follows:

- a charge of given momentum captured by a magnetic field will transcribe an orbit;
- closed orbits represent the equilibrium condition for the given charge, momentum and energy;
- the field can be analyzed for its ability to carry a smooth set of equilibrium orbits; and
- acceleration can be viewed as transition from one equilibrium orbit to another.

Meanwhile, the weak-focusing principle of perturbation theory can be described as follows:

- the particles oscillate about a mean trajectory (also, known as the central ray);
- oscillation frequencies ($v_r$, $v_z$) characterize motion in the radial (r) and axial (z) directions respectively;
- the magnet field is decomposed into coordinate field components and a field index (n); and $v_r=\sqrt{1-n}$, while $v_z=\sqrt{n}$; and
- resonances between particle oscillations and the magnetic field components, particularly field error terms, determine acceleration stability and losses.

In synchrocyclotrons, the weak-focusing field index parameter, n, noted above, is defined as follows:

$$n = -\frac{r}{B}\frac{dB}{dr},$$

where r is the radius of the ion (Q, M) from the main axis 16; and B is the magnitude of the axial magnetic field at that radius. The weak-focusing field index parameter, n, is in the range from zero to one across the entirety of the acceleration chamber (with the possible exception of the central region of the chamber proximate the main central axis 16, where the ions are introduced and where the radius is nearly zero) to enable the successful acceleration of ions to full energy in the synchrocyclotron, where the field generated by the coils dominates the field index. In particular, a restoring force is provided during acceleration to keep the ions oscillating with stability about the mean trajectory. One can show that this axial restoring force exists when n>0, and this requires that dB/dr<0, since B>0 and r>0 are true. The synchrocyclotron has a field that decreases with radius to match the field index required for acceleration. Alternatively, if the field index is known, one can specify, to some level of precision, an electromagnetic circuit including the positions and location of many of the features, as indicated in FIG. 2, to the level at which further detailed orbit and field computations can provide an optimized solution. With such a solution in hand, one can then scale that solution to a parameter set ($B_0$, E, Q, M and $V_0$).

In this regard, the rotation frequency, ω, of the ions rotating in the magnetic field of the synchrocyclotron is $$\omega=QB/\gamma M,$$

where γ is the relativistic factor for the increase in the particle mass with increasing frequency. This decreasing frequency with increasing energy in a synchrocyclotron is the basis for the synchrocyclotron acceleration mode of circular particle accelerators, and gives rise to an additional decrease in field with radius in addition to the field index change required for the axial restoring force. The voltage, V, across the gap is greater than a minimum voltage, $V_{min}$, needed to provide phase stability; at $V_{min}$, the particles have an energy at the gap that allows them to gain more energy when crossing the next gap. Additionally, synchrocyclotron acceleration involves the principle of phase stability, which may be characterized in that the available acceleration voltage nearly always exceeds the voltage required for ion acceleration from the center of the accelerator to full energy near the outer edge. When the radius, r, of the ion decreases, the accelerating electric field must increase, suggesting that there may by a practical limit to acceleration voltages with increasing magnetic field, B.

For a given known, working, high-field synchrocyclotron parameter set, the field index, n, that may be determined from these principle effects, among others, can be used to derive the radial variation in the magnetic field for acceleration. This B-versus-r profile can further be parameterized by dividing the magnetic fields in the data set by the actual magnetic-field value needed at full energy and also by dividing the corresponding radius values in this B-versus-r data set by the radius at which full energy is achieved. This normalized data set can then be used to scale to a synchrocyclotron acceleration solution at an even-higher central magnetic field, $B_0$, and resulting overall accelerator compactness, if it is also at least true that (a) the acceleration harmonic number, h, is constant, wherein the harmonic number refers to the multiplier between the acceleration-voltage frequency, $\omega_{RF}$, and the ion-rotation frequency, $\omega$, in the field, as follows:

$$\omega_{RF}=h\omega;$$

and (b) the energy gain per revolution, $E_t$, is constrained such that the ratio of $E_t$ to another factor is held constant, specifically as follows:

$$\frac{E_t}{QV_0 r^2 f(\gamma)} = \text{constant},$$

where $f(\gamma)=\gamma^2(1-0.25(\gamma^2-1))$.

The properties of superconducting coils are further considered, below, in order to further develop a higher-field synchrocyclotron using superconducting coils. A number of different kinds of superconductors can be used in superconducting coils; and among many important factors for engineering solutions, the following three factors are often used to characterize superconductors: magnetic field, current density and temperature. $B_{max}$ is the maximum magnetic field that may be supported in the superconducting filaments of the superconducting wire in the coils while maintaining a superconducting state at a certain useful engineering current density, $J_e$, and operating temperature, $T_{op}$. For the purpose of comparison, an operating temperature, $T_{op}$, of 4.5K is frequently used for superconducting coils in magnets, such as those proposed for superconducting synchrocyclotrons, particularly in the high-field superconducting synchrocyclotrons discussed herein. For the purpose of comparison, an engineering current density, $J_e$, of 1000 A/mm$^2$ is reasonably representative. The actual ranges of operating temperature and current densities are broader than these values.

The superconducting material, NbTi, is used in superconducting magnets and can be operated at field levels of up to 7 Tesla at 1000 A/mm$^2$ and 4.5 K, while $Nb_3Sn$ can be operated at field levels up to approximately 11 Tesla at 1000 A/mm$^2$ and 4.5K. However, it is also possible to maintain a temperature of 2K in superconducting magnets by a process known as sub-cooling; and, in this case, the performance of NbTi would reach operating levels of about 11 Tesla at 2K and 1000 A/mm$^2$, while $Nb_3Sn$ could reach about 15 Tesla at 2K and 1000 A/mm$^2$. In practice, one does not design magnets to operate at the field limit for superconducting stability; additionally, the field levels at the superconducting coils may be higher than those in the pole gap, so actual operating magnetic-field levels would be lower. Furthermore, detailed differences among specific members of these two conductor families would broaden this range, as would operating at a lower current density. These approximate ranges for these known properties of the superconducting elements, in addition to the orbit scaling rules presented earlier, enable selecting a particular superconducting wire and coil technology for a desired operating field level in a compact, high-field superconducting synchrocyclotron. In particular, superconducting coils made of NbTi and $Nb_3Sn$ conductors and operating at 4.5K span a range of operating field levels from low fields in synchrocyclotrons to fields in excess of 10 Tesla. Decreasing the operating temperature further to 2K expands that range to operating magnetic field levels of at least 14 Tesla.

Figure 4:
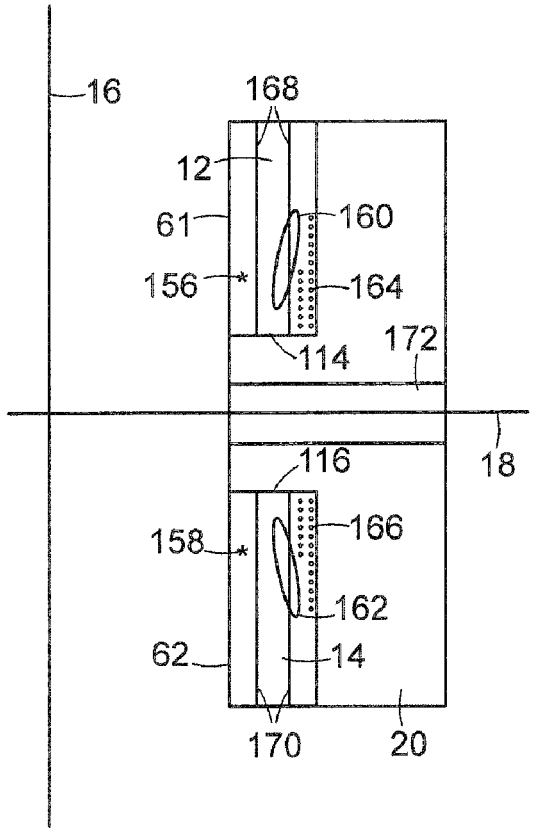
FIG. 4 is a sectional illustration of features of the high-field, split-pair superconducting coil set.
Figure 7:
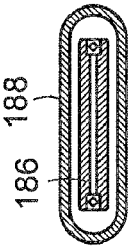
FIG. 7 is a sectional illustration taken through the resonator conductors in the apparatus of FIG. 5 at double the scale in size.
Figure 8:
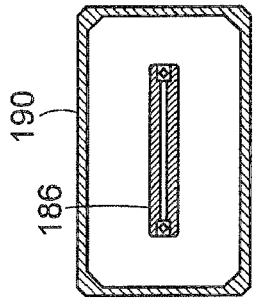
FIG. 8 is a sectional illustration taken through the resonator outer return yoke in the apparatus of FIG. 5 at double the scale in size.

Superconducting coils are also characterized by the level of magnetic forces in the windings and by the desirability of removing the energy quickly should, for any reason, a part of the winding become normal conducting at full operating current. The removal of energy is known as a magnet quench. There are several factors related to forces and quench protection in the split coil pair 12 and 14 of a superconducting synchrocyclotron, which are addressed for a scaled high-field superconducting synchrocyclotron using a selected conductor type to operate properly. As shown in FIG. 4, the coil set includes a split coil pair, with upper superconducting coil 12 and lower superconducting coil 14. The upper 12 and lower 14 superconducting coils are axially wound with alternating superconductor and insulating elements. Several types or grades of superconductor can be used, with different composition and characteristics.

Surfaces 168 in the upper superconducting coil 12 and surfaces 170 in the lower superconducting coil 14 schematically indicate boundaries where conductor grade is changed, in order to match the conductor to better the coil design. At these or other locations, additional structure may be introduced for special purposes, such as assisting quench protection or increasing the structural strength of the winding. Hence, each superconducting coil 12 and 14 can have multiple segments separated by boundaries 168 and 170. Although three segments are illustrated in FIG. 4, this is only one embodiment, and fewer or more segments may be used.

The upper and lower coils 12 and 14 are within a low-temperature-coil mechanical containment structure referred to as the bobbin 20. The bobbin 20 supports and contains the coils 12 and 14 in both radial and axial directions, as the upper and lower coils 12 and 14 have a large attractive load as well as large radial outward force. The bobbin 20 provides axial support for the coils 12 and 14 through their respective surfaces 114 and 116. Providing access to the acceleration chamber 46, multiple radial passages 172 are defined in and through the bobbin 20. In addition, multiple attachment structures (not shown) can be provided on the bobbin 20 so as to offer radial axial links for holding the coil/bobbin assembly in a proper location.

Point 156 in the upper superconducting coil 12 and point 158 in the lower superconducting coil 14 indicate approximate regions of highest magnetic field; and this field level sets the design point for the superconductor chosen, as discussed above. In addition, crossed region 164 in the upper superconducting coil 12 and crossed region 166 in the lower superconducting coil 14 indicate regions of magnetic field reversal; and in these cases, the radial force on the windings are directed inward and is to be mitigated. Regions 160 and 162 indicate zones of low magnetic field or nearly zero overall magnetic field level, and they exhibit the greatest resistance to quenching.

Figure 5:
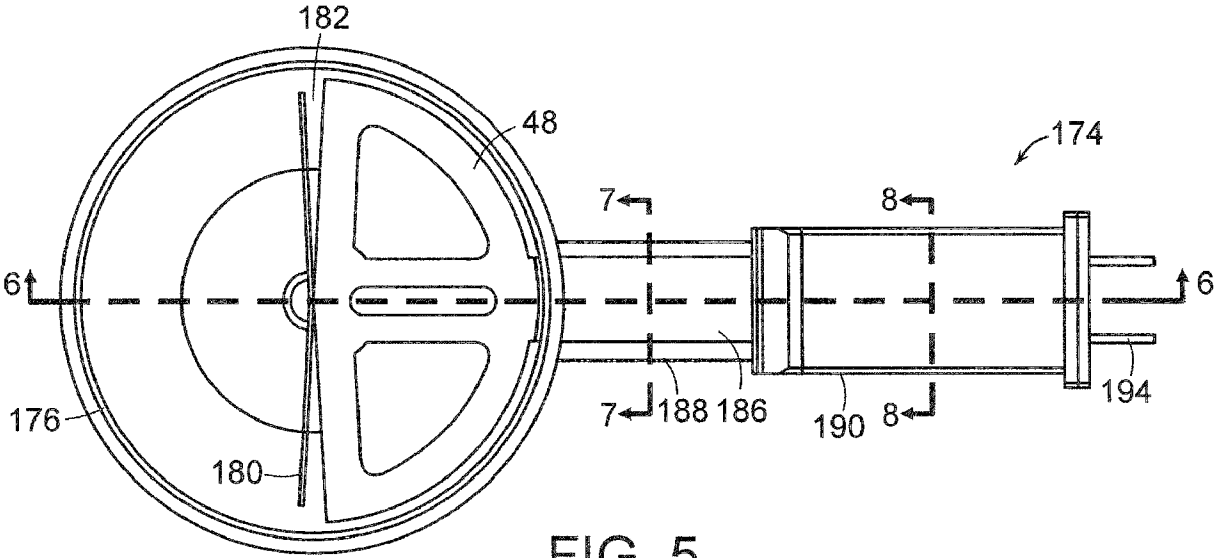
FIG. 5 is a sectional illustration of the synchrocyclotron beam chamber, accelerating dee and resonator.
Figure 6:
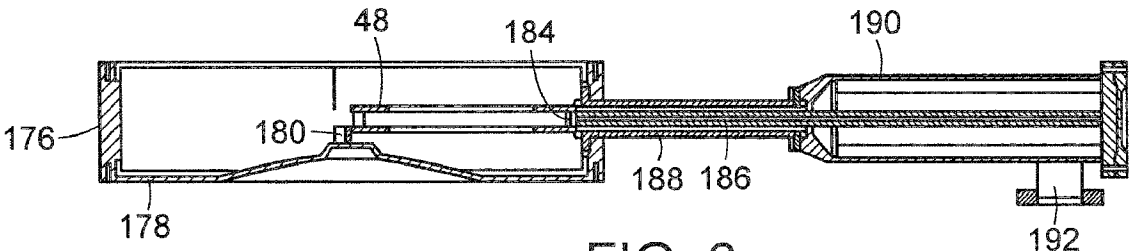
FIG. 6 is a sectional illustration of the apparatus of FIG. 5, with the section taken along the longitudinal axis shown in FIG. 5.

The compact high-field superconducting cyclotron includes elements for phase-stable acceleration, which are shown in FIGS. 5-8. FIGS. 5 and 6 provide a detailed engineering layout of one type of beam-accelerating structure, with a beam chamber 176 and resonator 174, for the 9.2 Tesla solution of FIG. 1, where the chamber 176 is located in the pole gap space. The elevation view of FIG. 5 shows only one of the dees 48 used for accelerating the ions, while the side view shows that this dee 48 is split above and below the median plane for the beam to pass within during acceleration. The dee 48 and the ions are in a volume under vacuum and defined by the beam chamber 176, which includes a beam-chamber base plate 178. The acceleration-gap-defining aperture 180 establishes the electrical ground plane. The ions are accelerated by the electric field across the acceleration gap 182 between the dee 48 and the acceleration-gap ground-plane defining aperture 180.

To establish the high fields desired across the gap 182, the dees 48 are connected to a resonator inner conductor 186 and to a resonator outer conductor 188 through dee-resonator connector 184. The outer resonator conductor 188 is connected to the cryostat 200 (shown in FIG. 9) of the high-field synchrocyclotron, a vacuum boundary maintained by the connection. The resonator frequency is varied by an RF rotating capacitor (not shown), which is connected to the accelerating dee 48 and the inner and outer conductors 186 and 198 through the resonator outer conductor return yoke 190 through the coupling port 192. The power is delivered to the RF resonant circuit through RF-transmission-line coupling port 194.

Figure 9:
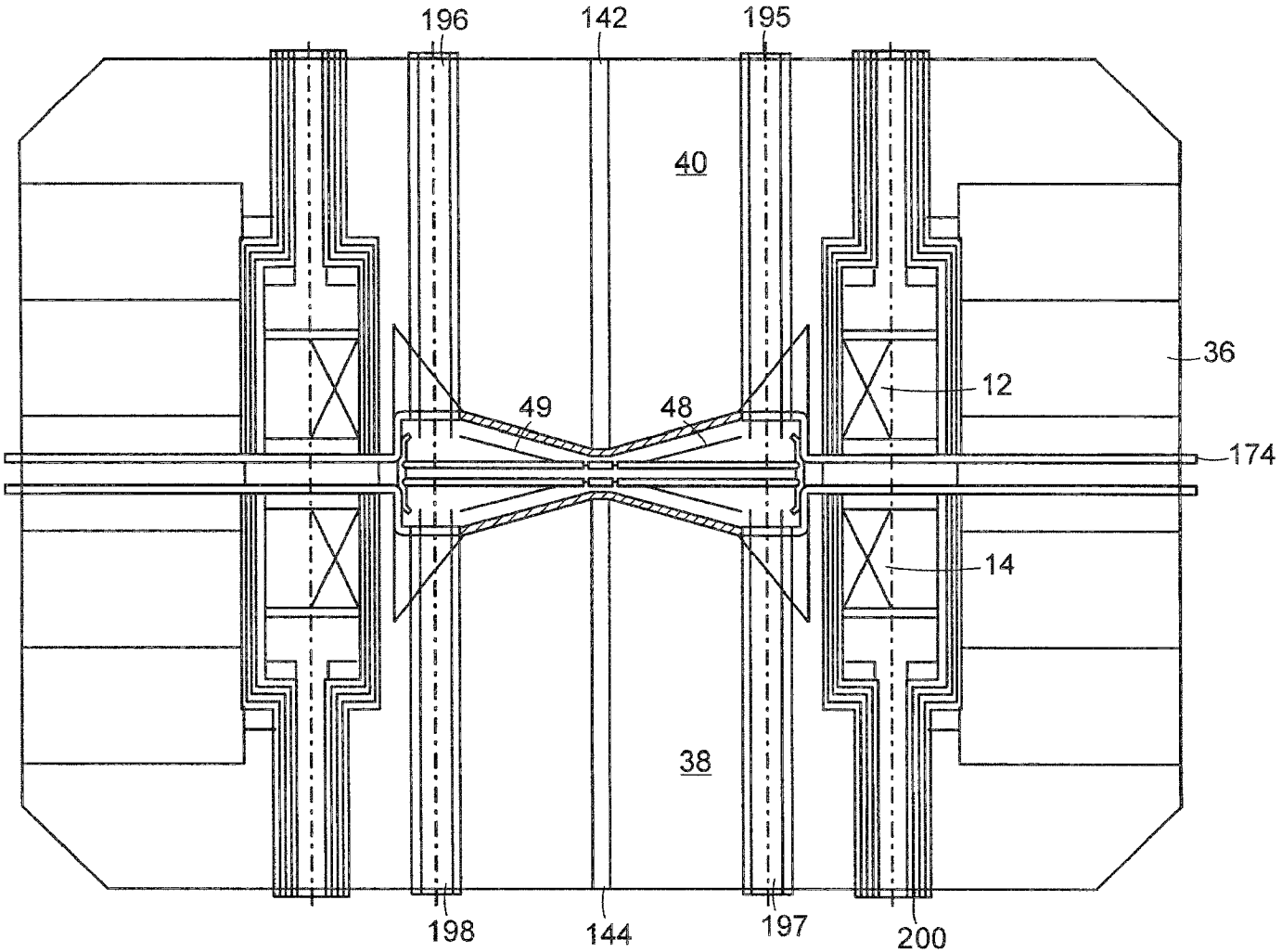
FIG. 9 shows an alternative RF configuration using two dees and axially directed RF ports.

In another embodiment, an alternative structure with two dees and axial RF resonator elements is incorporated into the compact high-field superconducting synchrocyclotron, as shown schematically in FIG. 9. Such a two-dee system may allow for increased acceleration rates or reduced voltages, $V_0$. Thus, two dees 48 and 49 are used; the dees 48 and 49 are separated into halves on opposite sides of the median plane and are energized by upper axial resonators 195 and 196 and by lower axial resonators 197 and 198, which are energized by external RF power sources (in addition to radial power feeds through passages 154, illustrated in FIG. 2). FIG. 9 also shows how the coil cryostat 200 is fitted into the ferromagnetic yoke structure 36.

Figure 10:
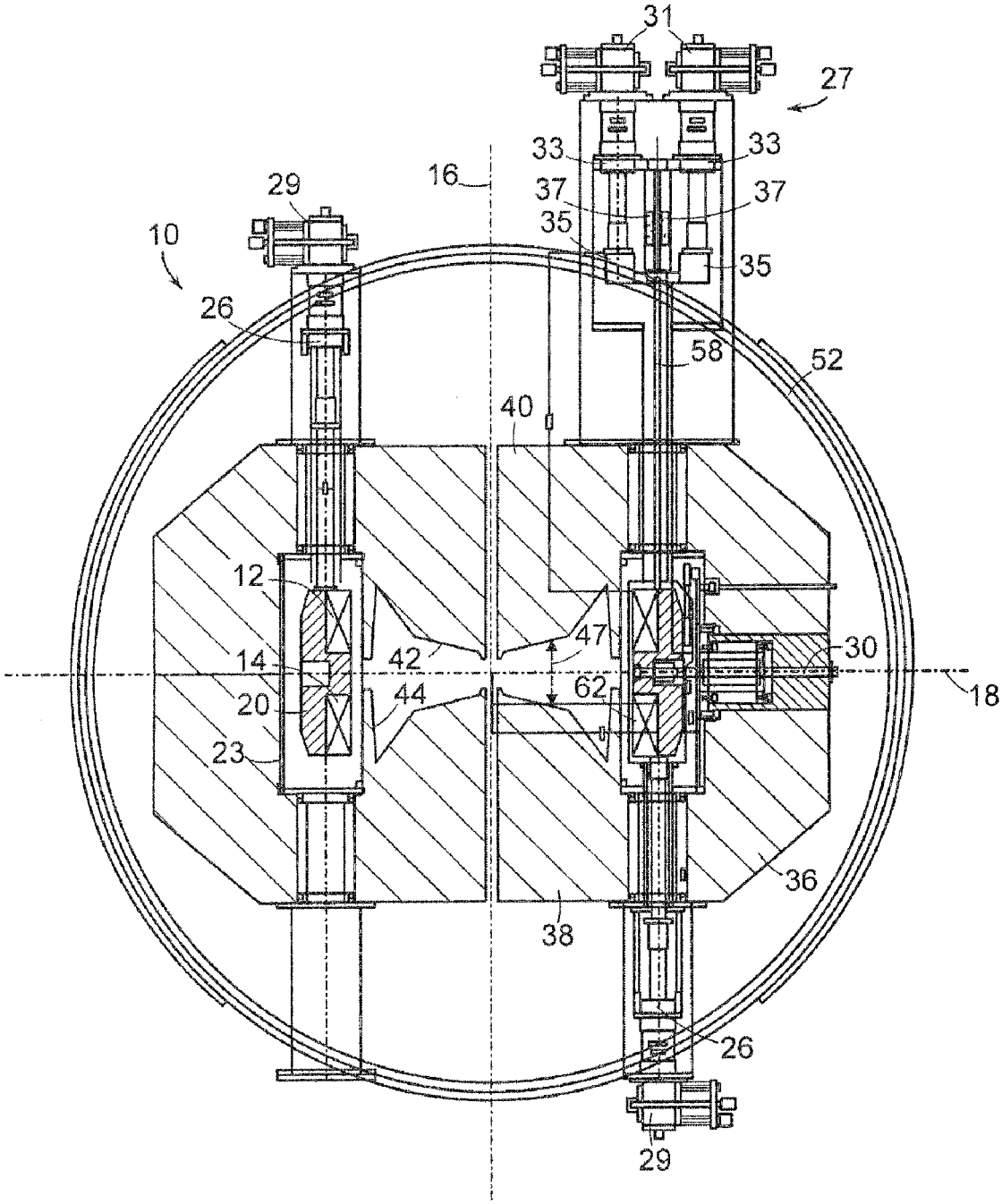
FIG. 10 is a sectional illustration of a magnet structure, viewed in a plane in which the central axis of the magnet structure lies.
Figure 11:
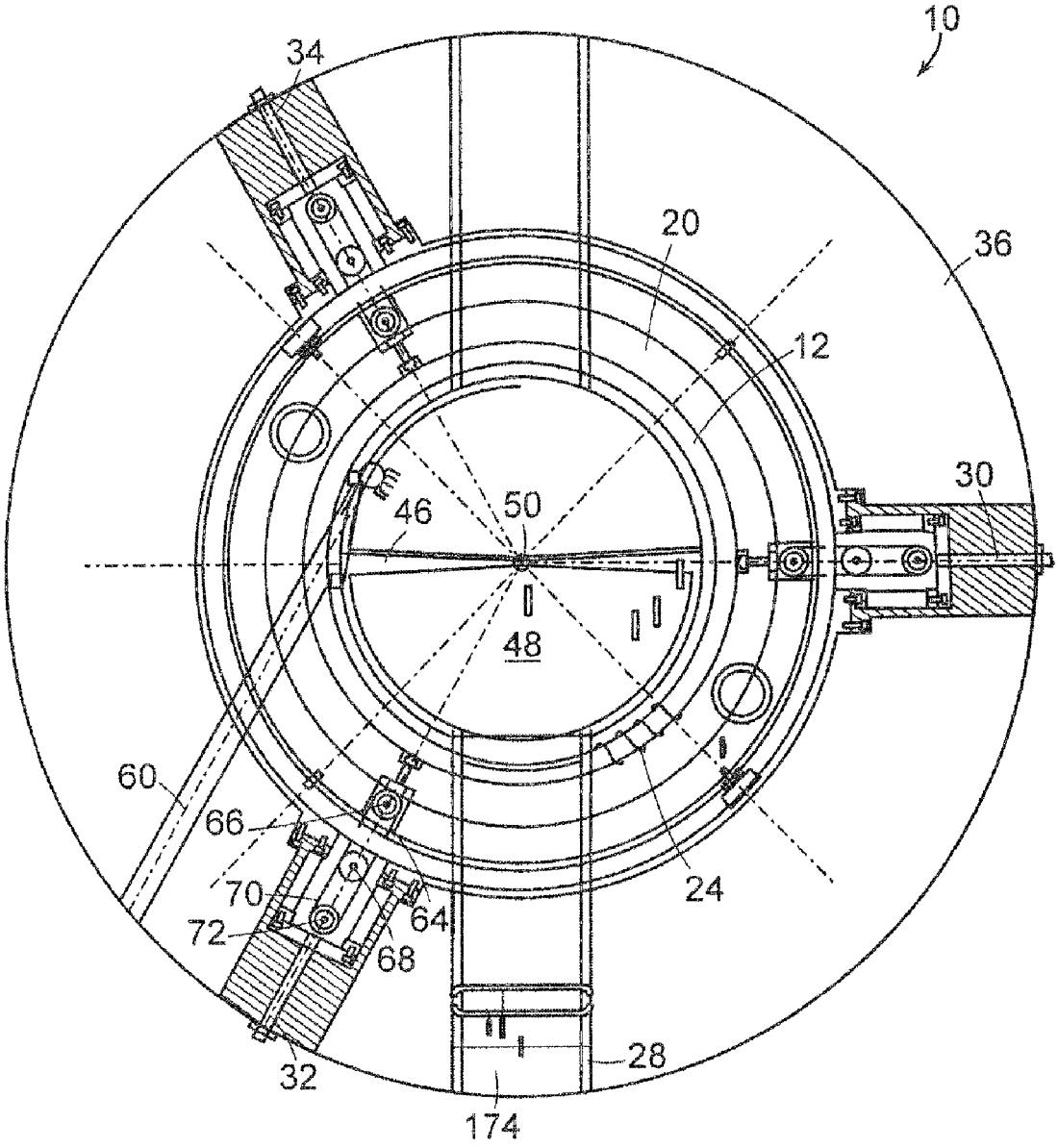
FIG. 11 is a sectional illustration of the magnet structure of FIG. 10, viewed in a plane normal to the central axis and parallel to the acceleration plane.

A more complete and detailed illustration of a magnet structure 10 for particle acceleration is illustrated in FIGS. 10 and 11. The magnet structure 10 can be used, e.g., in a compact synchrocyclotron (e.g., in a synchrocyclotron that otherwise shares the features of the synchrocyclotron disclosed in U.S. Pat. No. 4,641,057), in an isochronous cyclotron, and in other types of cyclotron accelerators in which ions (such as protons, deuterons, alpha particles, and other ions) can be accelerated.

Figure 12:
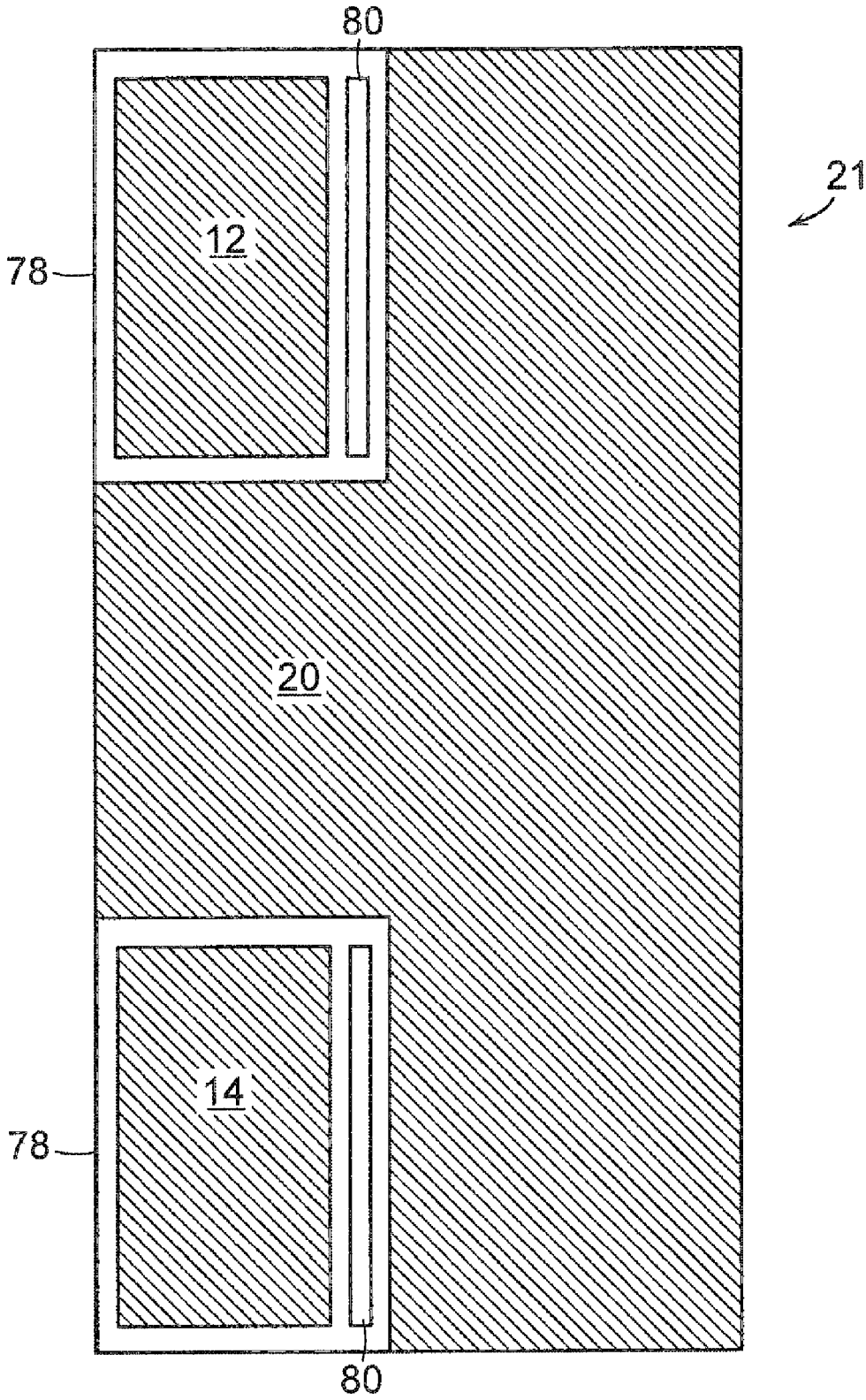
FIG. 12 is a sectional illustration of the cold-mass structure, including the coils and the bobbin.

Within the broader magnetic structure, high-energy magnet fields are generated by a cold-mass structure 21, which includes the pair of circular coils 12 and 14. As shown in FIG. 12, the pair of circular coils 12 and 14 are mounted inside respective copper thermal shields 78 maintained under vacuum with intimate mechanical contact between the coils 12 and 14 and the copper thermal shields 78. Also mounted in each copper thermal shield 78 is a pressurized bladder 80 that applies a radial inward force to counter the very high hoop tension force acting on each coil 12/14 during operation. The coils 12 and 14 are symmetrically arranged about a central axis 16 equidistant above and below an acceleration plane 18 in which the ions can be accelerated. The coils 12 and 14 are separated by a sufficient distance to allow for the RF acceleration system to extend there between into the acceleration chamber 46. Each coil 12/14 includes a continuous path of conductor material that is superconducting at the designed operating temperature, generally in the range of 4-6K, but also may be operated below 2K, where additional superconducting performance and margin is available. The radius of each coil is about 17.25 inches (~43.8 cm).

Figure 13:
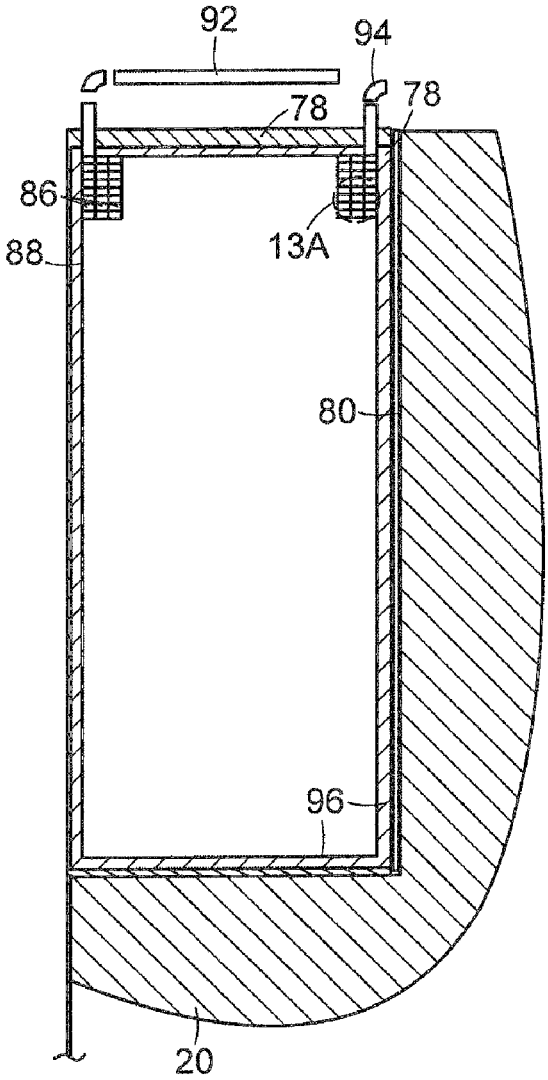
FIG. 13 is a sectional illustration, showing the interior structure of a coil.
Figure 13A:
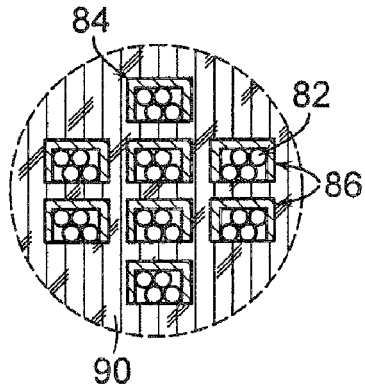
FIG. 13A is a magnified view of the section shown in FIG. 13.

As shown in FIG. 13, the coils 12 and 14 comprise superconductor cable or cable-in-channel conductor with individual cable strands 82 having a diameter of 0.6 mm and wound to provide a current carrying capacity of, e.g., between 2 million to 3 million total amps-turns. In one embodiment, where each strand 82 has a superconducting current-carrying capacity of 2,000 amperes, 1,500 windings of the strand are provided in the coil to provide a capacity of 3 million amps-turns in the coil. In general, the coil will be designed with as many windings as are needed to produce the number of amps-turns needed for a desired magnetic field level without exceeding the critical current carrying capacity of the superconducting strand. The superconducting material can be a low-temperature superconductor, such as niobium titanium (NbTi), niobium tin ($Nb_3Sn$), or niobium aluminum ($Nb_3Al$); in particular embodiments, the superconducting material is a type II superconductor—in particular, $Nb_3Sn$ having a type A15 crystal structure. High-temperature superconductors, such as $Ba_2Sr_2Ca_1Cu_2O_8$, $Ba_2Sr_2Ca_2Cu_3O_{10}$, or $YBa_2Cu_3O_{7-x}$, may also be used.

The cabled strands 82 are soldered into a U-shaped copper channel 84 to form a composite conductor 86. The copper channel 84 provides mechanical support, thermal stability during quench; and a conductive pathway for the current when the superconducting material is normal (i.e., not superconducting). The composite conductor 86 is then wrapped in glass fibers and then wound in an outward overlay. Strip heaters 88 formed, e.g., of stainless steel can also be inserted between wound layers of the composite conductor 86 to provide for rapid heating when the magnet is quenched and also to provide for temperature balancing across the radial cross-section of the coil after a quench has occurred, to minimize thermal and mechanical stresses that may damage the coils. After winding, a vacuum is applied, and the wound composite conductor structure is impregnated with epoxy to form a fiber/epoxy composite filler 90 in the final coil structure. The resultant epoxy-glass composite in which the wound composite conductor 86 is embedded provides electrical insulation and mechanical rigidity. A winding insulation layer 96 formed of epoxy-impregnated glass fibers lines the interior of the copper thermal shield 78 and encircles the coil 12.

In an embodiment in which the $Nb_3Sn$ is structured for use in a cyclotron, the coil is formed by encasing a wound strand of tin wires in a matrix of niobium powder. The wound strand and matrix are then heated to a temperature of about 650° C. for 200 hours to react the tin wires with the niobium matrix and thereby form $Nb_3Sn$. After such heat treatment, each $Nb_3Sn$ strand in the cable must carry a portion of the total electric current with sufficient current margin at the operating magnetic field and temperature to maintain the superconducting state. The specification of the copper channel cross-section and epoxy composite matrix allows the high field coil to maintain its superconducting state under greater mechanical stresses that occur in such compact coils. This improved peak stress migration is also highly advantageous where the coil is operated at higher current densities to increase the magnetic field that is generated, which is accompanied by greater forces acting on the superconducting coils. $Nb_3Sn$ conductors are brittle and may be damaged and lose some superconducting capability unless the stress state through all operations is properly limited. The wind-and-react method followed by the formation of an epoxy-composite mechanical structure around the windings enables these $Nb_3Sn$ coils to be used in other applications where superconductors are used or can be used, but where $Nb_3Sn$ may not otherwise be suitable due to the brittleness of standard $Nb_3Sn$ coils in previous embodiments.

The copper shields, with the coils 12 and 14 contained therein, are mounted in a bobbin 20 formed of a high-strength alloy, such as stainless steel or an austenitic nickel-chromium-iron alloy (commercially available as INCONEL 625 from Special Metals Corporation of Huntington, W. Va., USA). The bobbin 20 intrudes between the coils 12 and 14, but is otherwise outside the coils 12 and 14. The top and bottom portions of the bobbin 20 (per the orientation of FIG. 12), which are outside the coils, each has a thickness (measured horizontally, per the orientation of FIG. 12) approximately equal to the thickness of the coil 12/14. The cold-mass structure 21, including the coils 12 and 14 and the bobbin 20, is encased in an insulated and evacuated stainless steel or aluminum shell 23, called a cryostat, which can be mounted inside the iron pole and yoke 36. The cold-mass structure 21 circumscribes (i.e., at least partially defines) a space for an acceleration chamber 46 (see FIG. 11) for accelerating ions and a segment of the central axis 16 extending across the acceleration chamber 46.

As shown in FIG. 11, the magnet structure 10 also includes an electrically conducting wire 24 (e.g., in the form of a cable) encircling each coil 12/14 (e.g., in a spiral around the coil, just a small portion of which is illustrated in FIG. 11) for quenching the coil 12/14 as it goes "normal" due to increasing temperature. A voltage or current sensor is also coupled with the coils 12 and 14 to monitor for an increase in electrical resistance in either coil 12/14, which would thereby signify that a portion of the coil 12/14 is no longer superconducting.

As shown in FIG. 10, cryocoolers 26, which can utilize compressed helium in a Gifford-McMahon refrigeration cycle or which can be of a pulse-tube cryocooler design, are thermally coupled with the cold-mass structure 21. The coupling can be in the form of a low-temperature superconductor (e.g., NbTi) current lead in contact with the coil 12/14. The cryocoolers 26 can cool each coil 12/14 to a temperature at which it is superconducting. Accordingly, each coil 12/14 can be maintained in a dry condition (i.e., not immersed in liquid helium or other liquid refrigerant) during operation, and no liquid coolant need be provided in or about the cold-mass structure 21 either for cool-down of the cold mass or for operating of the superconducting coils 12/14.

A second pair of cryocoolers 27, which can be of the same or similar design to cryocoolers 26, are coupled with the current leads 37 and 58 to the coils 12 and 14. High-temperature current leads 37 are formed of a high-temperature superconductor, such as $Ba_2Sr_2Ca_1Cu_2O_8$ or $Ba_2Sr_2Ca_2Cu_3O_{10}$, and are cooled at one end by the cold heads 33 at the end of the first stages of the cryocoolers 27, which are at a temperature of about 80 K, and at their other end by the cold heads 35 at the end of the second stages of the cryocoolers 27, which are at a temperature of about 4.5 K. The high-temperature current leads 37 are also conductively coupled with a voltage source. Lower-temperature current leads 58 are coupled with the higher-temperature current leads 37 to provide a path for electrical current flow and also with the cold heads 35 at the end of the second stages of the cryocoolers 27 to cool the low-temperature current leads 58 to a temperature of about 4.5 K. Each of the low-temperature current leads 58 also includes a wire 92 that is attached to a respective coil 12/14; and a third wire 94, also formed of a low-temperature superconductor, couples in series the two coils 12 and 14. Each of the wires can be affixed to the bobbin 20. Accordingly, electrical current can flow from an external circuit possessing a voltage source, through a first of the high-temperature current leads 37 to a first of the low-temperature current leads 58 and into coil 12; the electrical current can then flow through the coil 12 and then exit through the wire joining the coils 12 and 14. The electrical current then flows through the coil 14 and exits through the wire of the second low-temperature current lead 58, up through the low-temperature current lead 58, then through the second high-temperature current lead 37 and back to the voltage source.

The cryocoolers 29 and 31 allow for operation of the magnet structure away from sources of cryogenic cooling fluid, such as in isolated treatment rooms or also on moving platforms. The pair of cryocoolers 26 and 27 permit operation of the magnet structure with only one cryocooler of each pair having proper function.

At least one vacuum pump (not shown) is coupled with the acceleration chamber 46 via the resonator 28 in which a current lead for the RF accelerator electrode is also inserted. The acceleration chamber 46 is otherwise sealed, to enable the creation of a vacuum in the acceleration chamber 46.

Radial-tension links 30, 32 and 34 are coupled with the coils 12 and 14 and bobbin 20 in a configuration whereby the radial-tension links 30, 32 and 34 can provide an outward hoop force on the bobbin 20 at a plurality of points so as to place the bobbin 20 under radial outward tension and keep the coils 12 and 14 centered (i.e., substantially symmetrical) about the central axis 16. As such, the tension links 30, 32 and 34 provide radial support against magnetic de-centering forces whereby the cold mass approaching the iron on one side sees an exponentially increasing force and moves even closer to the iron. The radial-tension links 30, 32 and 34 comprise two or more elastic tension bands 64 and 70 with rounded ends joined by linear segments (e.g., in the approximate shape of a conventional race or running track) and have a right circular cross-section. The bands are formed, e.g., of spiral wound glass or carbon tape impregnated with epoxy and are designed to minimize heat transfer from the high-temperature outer frame to the low-temperature coils 12 and 14. A low-temperature band 64 extends between support peg 66 and support peg 68. The lowest-temperature support peg 66, which is coupled with the bobbin 20, is at a temperature of about 4.5 K, while the intermediate peg 68 is a temperature of about 80 K. A higher-temperature band 70 extends between the intermediate peg 68 and a high-temperature peg 72, which is at a near-ambient temperature of about 300 K. An outward force can be applied to the high-temperature peg 72 to apply additional tension at any of the tension links 30, 32 and 34 to maintain centering as various de-centering forces act on the coils 12 and 14. The pegs 66, 68, and 72 can be formed of stainless steel.

Likewise, similar tension links can be attached to the coils 12 and 14 along a vertical axis (per the orientation of FIGS. 10 and 12) to counter an axial magnetic decentering force in order to maintain the position of the coils 12 and 14 symmetrically about the mid-plane 18. During operation, the coils 12 and 14 will be strongly attracted to each other, though the thick bobbin 20 section between the coils 12 and 14 will counterbalance those attractive forces.

The set of radial and axial tension links support the mass of the coils 12 and 14 and bobbin 20 against gravity in addition to providing the required centering force. The tension links may be sized to allow for smooth or step-wise three-dimensional translational or rotational motion of the entire magnet structure at a prescribed rate, such as for mounting the magnet structure on a gantry, platform or car to enable moving the proton beam in a room around a fixed targeted irradiation location. Both the gravitational support and motion requirements are tension loads not in excess of the magnetic decentering forces. The tension links may be sized for repetitive motion over many motion cycles and years of motion.

A magnetic yoke 36 formed of low-carbon steel surrounds the coils 12 and 14 and cryostat 23. Pure iron may be too weak and may possess an elastic modulus that is too low; consequently, the iron can be doped with a sufficient quantity of carbon and other elements to provide adequate strength or to render it less stiff while retaining the desired magnetic levels. The yoke 36 circumscribes the same segment of the central axis 16 that is circumscribed by the coils 12 and 14 and the cryostat 23. The radius (measured from the central axis) at the outer surfaces of the yoke 36 can be about 35 inches (~89 cm) or less.

The yoke 36 includes a pair of poles 38 and 40 having tapered inner surfaces 42 and 44 that define a pole gap 47 between the poles 38 and 40 and across the acceleration chamber 46. The profiles of those tapered inner surfaces 42 and 44 are a function of the position of the coils 12 and 14. The tapered inner surfaces 42 and 44 are shaped such that the pole gap 47 (measured as shown by the reference line in FIG. 10) expands over an inner stage defined between opposing surfaces 42 as the distance from the central axis 16 increases and decreases over an outer stage defined between opposing surfaces 44 as the distance from the central axis 16 further increases. The inner stage establishes a correct weak focusing requirement for ion (e.g., proton) acceleration when used, e.g., in a synchrocyclotron for proton acceleration, while the outer stage is configured to reduce pole diameter by increasing energy gain versus radius, which facilitates extraction of ions from the synchrocyclotron as the ions approach the perimeter of the acceleration chamber 46.

Figure 16:
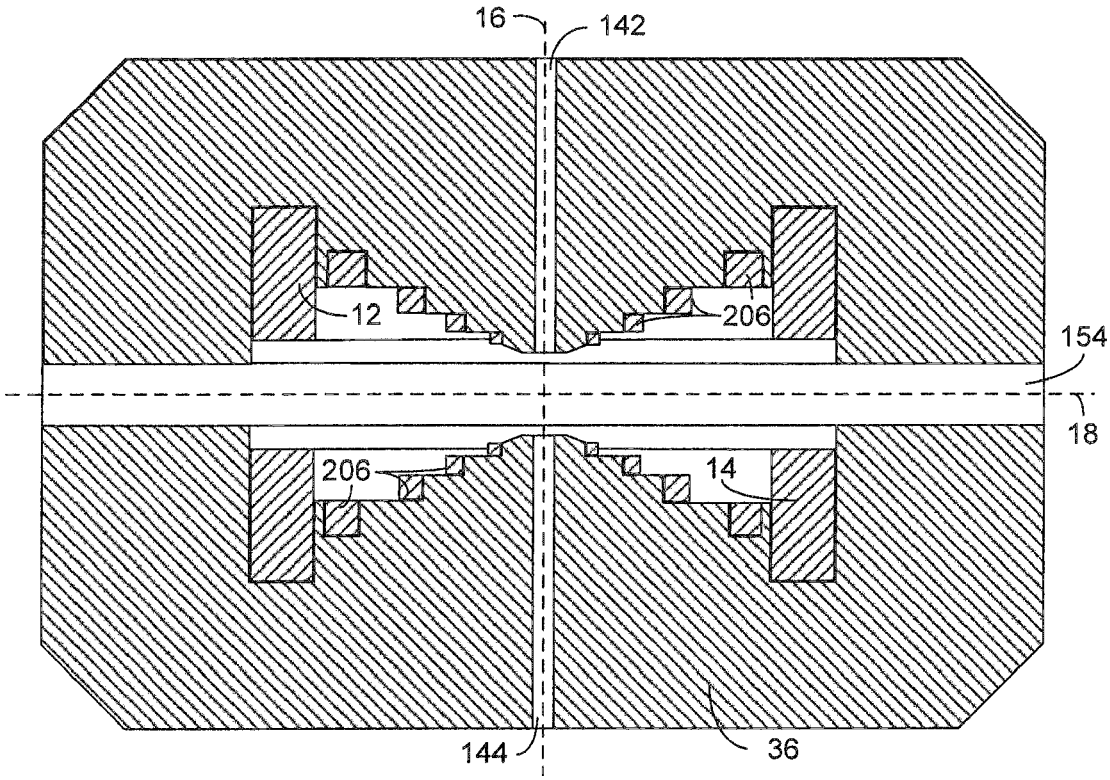
FIG. 16 is a sectional illustration of the basic form of a magnet structure (with particular details omitted) that includes additional active coils in the acceleration chamber to shape the magnetic field at the acceleration plane.

The pole profile thus described has several important acceleration functions, namely, ion guiding at low energy in the center of the machine, capture into stable acceleration paths, acceleration, axial and radial focusing, beam quality, beam loss minimization, attainment of the final desired energy and intensity, and the positioning of the final beam location for extraction. In particular, in synchrocyclotrons, the simultaneous attainment of weak focusing and acceleration phase stability is achieved. At higher fields achieved in this magnet structure, the expansion of the pole gap over the first stage provides for sufficient weak focusing and phase stability, while the rapid closure of the gap over the outer stage is responsible for maintaining weak focusing against the deleterious effects of the strong superconducting coils, while properly positioning the full energy beam near the pole edge for extraction into the extraction channel. In embodiments, where the magnetic field to be generated by the magnet is increased, the rate at which the gap opening increases with increasing radius over the inner stage is made greater, while the gap is closed over the outer stage to a narrower separation distance. Since the iron in the poles is fully magnetically saturated at pole strength above 2 Tesla, this set of simultaneous objectives can be accomplished by substituting a nested set of additional superconducting coils 206 (e.g., superconducting at a temperature of at least 4.5K) in the acceleration chamber in place of the tapered surfaces of the poles and having currents in those nested coils optimized to match the field contribution of the poles to the overall acceleration field, as shown in FIG. 16.

These radially distributed coils 206 can be embedded in the yoke 26 or mounted (e.g., bolted) to the yoke 26. At least one of these additional superconducting coils 206 generates a magnetic field in local opposition to the two primary superconducting coils 12 and 14. In this embodiment, the yoke 36 also is cooled (e.g., by one or more cryocoolers). Though not shown, an insulated structure can be provided through the radial median-plane passages 154, with the acceleration chamber contained within this insulated structure so that the acceleration chamber can be maintained at a warm temperature. The opposing field is generated in the internal coils 206 by passing current through the additional magnetic coils 206 in the opposite direction from which current is passed in the primary coils 12 and 14. Use of the additional active coils 206 in the acceleration chamber can be particularly advantageous in contexts where the field in the acceleration plane 18 is greater than 12 Tesla and where more field compensation is accordingly needed to maintain the decrease in the field with radius while maintaining weak focusing and phase stability. The higher-field magnet structures will have smaller external radii. For example, a magnet structure for producing a magnetic field of 14 Tesla in the median acceleration plane 18 can be constructed with the yoke having an outer radius of just over one foot (i.e., just over 30 cm).

In other embodiments, the yoke 36 can be omitted, and the field can be generated entirely by superconducting coils 12, 14 and 206. In another embodiment, the iron in the yoke 36 is replaced with another strong ferromagnetic material, such as gadolinium, which has a particularly high saturation magnetism (e.g., up to about 3 Tesla).

The iron yoke provides sufficient clearance for insertion of a resonator structure 174 including the radiofrequency (RF) accelerator electrodes 48 (also known as "dees") formed of a conductive metal. The electrodes 48 are part of a resonator structure 174 that extends through the sides of the yoke 36 and passes through the cryostat 23 and between the coils 12 and 14. The accelerator electrodes 48 include a pair of flat semicircular parallel plates that are oriented parallel to and above and below the acceleration plane 18 inside the acceleration chamber 46 (as described and illustrated in U.S. Pat. No. 4,641,057). The electrodes 48 are coupled with an RF voltage source (not shown) that generates an oscillating electric field to accelerate emitted ions from the ion source 50 in an expanding orbital (spiral) path in the acceleration chamber 46. Additionally, a dummy dee can be provided in the form of a planar sheet oriented in a plane of the central axis 16 (i.e., a plane that intersects the central axis in the orientation of FIG. 10 and extends orthogonally from the page) and having a slot defined therein to accommodate the acceleration plane for the particles. Alternatively, the dummy dee can have a configuration identical to that of the electrodes 48, though the dummy dee would be coupled with an electrical ground rather than with a voltage source.

Figure 14:
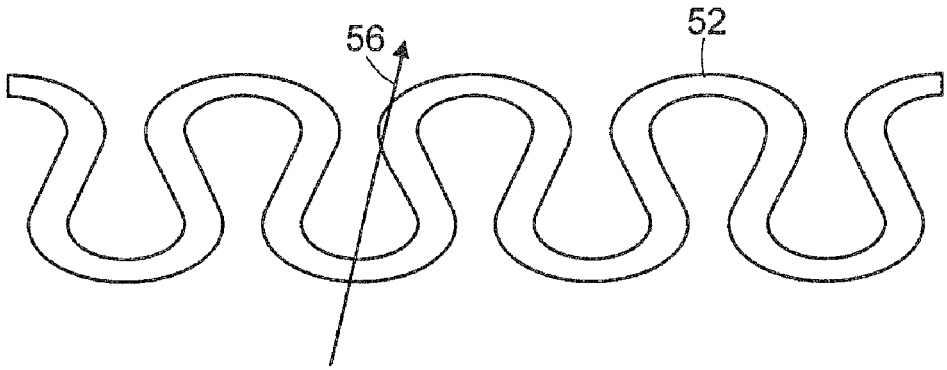
FIG. 14 is a sectional illustration of an integral magnetic shield having a contorted shape.
Figure 15:
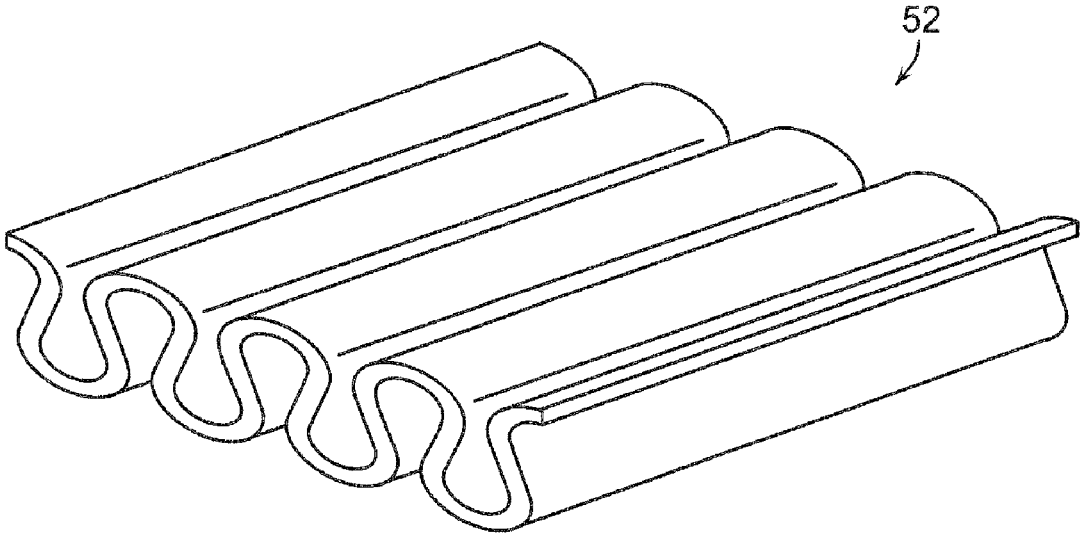
FIG. 15 is a perspective view of a section of the integral magnetic shield of FIG. 14.

An integral magnetic shield 52 circumscribes the other components of the magnet structure 10. The integral magnetic shield 52 can be in the form of a thin sheet (e.g., having a thickness of 2 cm) of low-carbon steel. As shown in FIG. 10, multiple sheets can be stacked together at selected locations to provide additional shielding of sensitive areas, as is evident where the sheets are triple stacked along the sides in FIG. 10. Alternatively, the shield 52 can have a tortuous shape (e.g., resembling a collapsed accordion structure), as shown in FIGS. 14 and 15, and is configured such that a majority of the magnetic field generated by the coils 12 and 14 and by the yoke 36 will need to pass through the integral magnetic shield 52 at a plurality of locations and at a plurality of angles relative to the local orientation of the shield 52. In the embodiment of FIG. 14, the integral magnetic shield 52 has a profile wherein its orientation gradually shifts back and forth between being perpendicular to and being parallel to radial vectors 56 from the central axis 16. Each radial vector 56 would intersect the shield 52 at two or more different locations—including at a near perpendicular angle and at a near tangential angle. At a first point of intersection 74, where the vector 56 crosses the integral magnetic shield 52 at a near perpendicular, a normal magnetic-field component is canceled; while at a second intersection, where the vector 56 crosses the integral magnetic shield 52 at a near tangent, a tangential magnetic-field component is canceled.

The integral magnetic shield 52 is mounted at a distance from the outer surface of the magnetic yoke 36 such that it is positioned outside the contour of a 1,000-gauss magnetic-flux density generated outside the yoke 36 when a voltage is applied to the superconducting coils 12 and 14 to generate a magnetic field of 8 Tesla or more inside the acceleration chamber 46. Accordingly, the integral magnetic shield 52 is positioned sufficiently far from the yoke 36 so that it will not be fully magnetized by the field, and it serves to suppress the far field that would otherwise be emitted from the magnet structure 10.

The heads 29 and 31 of the cryocoolers 26 and 27 are positioned outside the integral magnetic shield 52 to shield the heads 29 and 31 from magnetic fields (which can compromise the operability of the cryocooler due to field limits in the heads 29 and 31). Accordingly, the integral magnetic shield 52 defines respective ports therein, through which the cryocoolers 26 and 27 can be inserted.

Operation of the above-described magnet structure 10 to generate a magnetic field for accelerating ions will now be described in the following pages.

When the magnet structure 10 is in operation, the cryocoolers 26 are used to extract heat from the superconducting coils 12 and 14 so as to drop the temperature of each below its critical temperature (at which it will exhibit superconductivity). The temperature of coils formed of low-temperature superconductors is dropped to about 4.5 K.

A voltage (e.g., sufficient to generate 2,000 A of current through the current lead in the embodiment with 1,500 windings in the coil, described above) is applied to each coil 12/14 via the current lead 58 to generate a magnetic field of at least 8 Tesla within the acceleration chamber 46 when the coils are at 4.5 K. In particular embodiments using, e.g., $Nb_3Sn$, a voltage is applied to the coils 12 and 14 to generate a magnetic field of at least about 9 Tesla within the acceleration chamber 46. Moreover, the field can generally be increased an additional 2 Tesla by using the cryocoolers to further drop the coil temperature to 2 K, as discussed, above. The magnetic field includes a contribution of about 2 Tesla from the fully magnetized iron poles 38 and 40; the remainder of the magnetic field is produced by the coils 12 and 14.

This magnet structure serves to generate a magnetic field sufficient for ion acceleration. Pulses of ions (e.g., protons) can be emitted from the ion source 50 (e.g., the ion source described and illustrated in U.S. Pat. No. 4,641,057). Free protons can be generated, e.g., by applying a voltage pulse to a cathode to cause electrons to be discharged from the cathode into hydrogen gas; wherein, protons are emitted when the electrons collide with the hydrogen molecules.

In this embodiment, The RF accelerator electrodes 48 generate a voltage difference of 20,000 Volts across the plates. The electric field generated by the RF accelerator electrodes 48 has a frequency matching that of the cyclotron orbital frequency of the ion to be accelerated. The field generated by the RF accelerator electrodes 48 oscillates at a frequency of 140 MHz when the ions are nearest the central axis 16, and the frequency is decreased to as low as 100 MHz when the ions are furthest from the central axis 16 and nearest the perimeter of the acceleration chamber 46. The frequency is dropped to offset the increase in mass of the proton as it is accelerated, as the alternating frequency at the electrodes 48 alternately attracts and repels the ions. As the ions are thereby accelerated in their orbit, the ions speed up and spiral outward.

When the accelerated ions reach an outer radial orbit in the acceleration chamber 46, the ions can be drawn out of the acceleration chamber 46 (in the form of a pulsed beam) by magnetically leading them with magnets positioned about the perimeter of the acceleration chamber 46 into a linear beam-extraction passage 60 extending from the acceleration chamber 46 through the yoke 36 and then through a gap in the integral magnetic shield 52 toward, e.g., an external target. The radial tension links 30, 32 and 34 are activated to impose an outward radial hoop force on the cold-mass structure 21 to maintain its position throughout the acceleration process.

The integral magnetic shield 52 contains the magnetic field generated by the coils 12 and 14 and poles 38 and 40 so as to reduce external hazards accompanying the attraction of, e.g., pens, paper clips and other metallic objects toward the magnet structure 10, which would occur absent employment of the integral magnetic shield 52. Interaction between the magnetic field lines and the integral magnetic shield 52 at various angles is highly advantageous, as both normal and tangential magnetic fields are generated by the magnet structure 10, and the optimum shield orientation for containing each differs by 90°. This shield 52 can limit the magnitude of the magnetic field transmitted out of the yoke 36 through the shield 52 to less than 0.00002 Tesla.

When an increase in voltage or a drop in current through a coil 12/14 is detected, thereby signifying that a localized portion of the superconducting coil 12/14 is no longer superconducting, a sufficient voltage is applied to the quenching wire 24 that encircles the coil 12/14. This voltage generates a current through the wire 24, which thereby generates an additional magnetic field to the individual conductors in the coil 12/14, which renders them non-superconducting (i.e., "normal") throughout. This approach solves a perceived problem in that the internal magnetic field in each superconducting coil 12/14, during operation, will be very high (e.g., 11 Tesla) at its inner surface 62 and will drop to as low as zero at an internal point. If a quench occurs, it will likely occur at a high-field location while a low-field location may remain cold and superconducting for an extended period. This quench generates heat in the parts of the superconductor of coils 12/14 that are normal conducting; consequently, the edge will cease to be superconducting as its temperature rises, while a central region in the coil will remain cold and superconducting. The resulting heat differential would otherwise cause destructive stresses in the coil due to differential thermal contraction. This practice of inductive quenching is intended to prevent or limit this differential and thereby enable the coils 12 and 14 to be used to generate even higher magnetic fields without being destroyed by the internal stresses. Alternatively, current may be passed through the heater strips 88 causing the heater strip temperatures to rise well above 4.5 K and thereby locally heat the superconductors to minimize the internal temperature differentials during a quench.

Cyclotrons incorporating the above-described apparatus can be utilized for a wide variety of applications including proton radiation therapy for humans; etching (e.g., microholes, filters and integrated circuits); radioactivation of materials for materials studies; tribology; basic-science research; security (e.g., monitoring of proton scattering while irradiating target cargo with accelerated protons); production of medical isotopes and tracers for medicine and industry; nanotechnology; advanced biology; and in a wide variety of other applications in which generation of a point-like (i.e., small spatial-distribution) beam of high-energy particles from a compact source would be useful.

In describing embodiments of the invention, specific terminology is used for the sake of clarity. For purposes of description, each specific term is intended to at least include all technical and functional equivalents that operate in a similar manner to accomplish a similar purpose. Additionally, in some instances where a particular embodiment of the invention includes a plurality of system elements or method steps, those elements or steps may be replaced with a single element or step; likewise, a single element or step may be replaced with a plurality of elements or steps that serve the same purpose. Further, where parameters for various properties are specified herein for embodiments of the invention, those parameters can be adjusted up or down by $1/20^{th}$, $1/10^{th}$, $1/5^{th}$, $1/3^{rd}$, ½, etc., or by rounded-off approximations thereof, within the scope of the invention unless otherwise specified. Moreover, while this invention has been shown and described with references to particular embodiments thereof, those skilled in the art will understand that various substitutions and alterations in form and details may be made therein without departing from the scope of the invention; further still, other aspects, functions and advantages are also within the scope of the invention. The contents of all references, including patents and patent applications, cited throughout this application are hereby incorporated by reference in their entirety. The appropriate components and methods of those references may be selected for the invention and embodiments thereof. Still further, the components and methods identified in the Background section are integral to this disclosure and can be used in conjunction with or substituted for components and methods described elsewhere in the disclosure within the scope of the invention.

What is claimed is:

1. A synchrocyclotron magnet structure including a magnetic yoke comprising a pair of poles that define an acceleration chamber including a median acceleration plane and a central axis orthogonal to the median acceleration plane, wherein the magnetic yoke defines passages about the acceleration chamber and on opposite sides of the median acceleration plane for mounting a pair of magnetic coils, wherein the poles are joined at a perimeter and separated to form a pole gap of at least 3.8 cm across and throughout the acceleration chamber, wherein each pole has an inner surface that is tapered to produce a perimeter pole wing distal from the central axis and proximate the passages for the coils, a central pole tip proximate the central axis and distal from the passages for the coils, and a peak pole gap at an intermediate distance between the central pole tips and the perimeter pole wings, the peak pole gap being at least triple the pole gap between the central pole tips and at least triple the pole gap between the perimeter pole wings at all radial angles about the central axis, and wherein the poles are tapered to shape a combined magnetic field jointly produced by the magnetic yoke and by magnetic coils in the passages so that, when the magnetic coils directly generate a central magnetic field in the median acceleration plane of at least 5 Tesla and fully magnetize the magnetic yoke, the combined magnetic field across the median acceleration plane decreases with increasing radius and a weak-focusing field index parameter, n, is in the range from 0 to 1 from the central pole tips to the perimeter pole wings, where $n=-(r/B)(dB/dr)$, and where B is the magnetic field, and r is the radius from the central axis.

2. The magnet structure of claim 1, wherein the peak pole gap is closer to the outer pole wings than to the pole tips.

3. The magnet structure of claim 2, wherein the pole wings have inner surfaces that slope toward the median acceleration plane at an angle between 80 and 90° with the median acceleration plane.

4. The magnet structure of claim 2, wherein the pole wings have inner surfaces that slope toward the median acceleration plane at an angle from 82.5° to 87.5° with the median acceleration plane.

5. The magnet structure of claim 2, wherein the peak pole gap is at least five times the pole gap between the inner pole tips and at least five times the pole gap between the outer pole wings.

6. The magnet structure of claim 1, wherein the peak pole gap is between 19 and 55 cm.

7. The magnet structure of claim 1, wherein the peak pole gap is between 37 and 55 cm.

8. The magnet structure of claim 1, further comprising magnetic coils in the passages defined in the magnetic yoke.

9. The magnet structure of claim 8, wherein the magnetic coils are spaced apart from each other by between 5 and 15 cm.

10. The magnet structure of claim 8, wherein the magnetic coils are spaced apart from each other by between 8 and 12 cm.

11. The magnet structure of claim 1, wherein the separation between the poles across and throughout the acceleration chamber is at least 6 cm.

12. The magnet structure of claim 1, wherein the magnetic yoke has an outer radius, measured from the central axis parallel to the median acceleration plane, of between 71 cm and 1.14 m.

13. The magnet structure of claim 1, wherein the magnetic yoke has a height, measured orthogonal to the median acceleration plane, less than 100 cm.

14. The magnet structure of claim 1, wherein the magnetic yoke has a mass less than 23,000 kg.

15. The magnet structure of claim 1, wherein the magnetic yoke contains a resonator structure including at least one pair of semicircular dee electrodes between the poles for generating a particle-acceleration voltage in the acceleration chamber.

16. The magnet structure of claim 1, wherein the magnetic yoke is structured to contribute no more than 3 Tesla to the median acceleration plane when the magnetic yoke is fully magnetized.

17. The magnet structure of claim 1, wherein the weak-focusing field index parameter, n, is in the range from 0 to 1 across all of the median acceleration plane from the central pole tips to the perimeter pole wings.

18. The magnet structure of claim 1, wherein the inner surfaces of the poles are substantially circularly symmetrical about the central axis.

19. The magnet structure of claim 1, wherein the magnetic yoke further comprises localized magnetic tips positioned circumferentially on the pole wings.

20. The magnet structure of claim 1, wherein the coils comprise a material that is superconducting at a temperature of at least 4.5K.

21. The magnet structure of claim 20, wherein the coils comprise $Nb_3Sn$ or NbTi as the superconducting material.

22. A method for shaping a magnetic field for ion acceleration in a synchrocyclotron, the method comprising:

providing a magnet structure including:

a magnetic yoke comprising a pair of poles that define an acceleration chamber including a median acceleration plane and a central axis orthogonal to the median acceleration plane, wherein the magnetic yoke defines passages about the acceleration chamber and on opposite sides of the median acceleration plane, wherein the poles are joined at a perimeter and separated to form a pole gap across the acceleration chamber, and wherein each pole has an inner surface that is tapered to produce a perimeter pole wing distal from the central axis and proximate the passages for the coils, a central pole tip proximate the central axis and distal from the passages, and a peak pole gap at an intermediate distance between the central pole tips and the perimeter pole wings, the peak pole gap being at least triple the pole gap between the central pole tips and at least triple the pole gap between the perimeter pole wings;

a pair of magnetic coils mounted in the passages defined by the magnetic yoke on opposite sides of the median acceleration plane; and at least one pair of radiofrequency accelerator electrodes mounted between the poles;

passing electric current through the coils to generate a magnetic-field component in the median acceleration plane and to magnetize the magnetic yoke, the magnetized magnetic yoke generating another magnetic-field component in the median acceleration plane, wherein the coil-generated and magnetic-yoke-generated magnetic-field components jointly produce a combined magnetic field of at least 6.65 Tesla in the median acceleration plane, the combined magnetic field decreasing across the median acceleration plane with increasing radius and a weak-focusing field index parameter, n, being in the range from 0 to 1 from the central pole tips to the perimeter pole wings, where $n=-(r/B)(dB/dr)$, and where B is the magnetic field, and r is the radius from the central axis;

injecting an ion into the magnetic field in the acceleration chamber;

generating an electric field with the radiofrequency accelerator electrodes to accelerate the ion in an outward spiral trajectory across the median acceleration plane and reducing the frequency of the electric field as the ion accelerates outward; and then extracting the accelerated ion from the acceleration chamber.

23. The method of claim 22, wherein the radiofrequency accelerator electrodes impart the ion with an energy of at least 250 MeV.

24. The method of claim 22, wherein the magnetic yoke generates a magnetic-field component of no more than 2.4 Tesla in the acceleration chamber.

25. The method of claim 22, wherein each pole has a taper along its inner surface such that, when extending radially outward, the pole gap expands in a continuous series of increments and then shrinks in a continuous series of decrements.

26. The method of claim 22, wherein the ion includes more than one proton.

27. The method of claim 22, wherein the magnetic coils directly generate a magnetic-field component of at least 5 Tesla in the acceleration chamber.

* * * * *